US011004385B1

(12) United States Patent
Li et al.

(10) Patent No.: US 11,004,385 B1
(45) Date of Patent: May 11, 2021

(54) DISPLAY PANEL, DRIVING METHOD AND DISPLAY DEVICE

(71) Applicant: Xiamen Tianma Micro-Electronics Co., Ltd., Xiamen (CN)

(72) Inventors: Jieliang Li, Xiamen (CN); Yong Yuan, Shanghai (CN); Wanming Huang, Xiamen (CN)

(73) Assignee: XIAMEN TIANMA MICRO-ELECTRONICS CO., LTD., Xiamen (CN)

( * ) Notice: Subject to any disclaimer, the term of this patent is extended or adjusted under 35 U.S.C. 154(b) by 0 days.

(21) Appl. No.: 17/012,388

(22) Filed: Sep. 4, 2020

(30) Foreign Application Priority Data

Jun. 30, 2020 (CN) ..... 202010622533.9

(51) Int. Cl.
*G09G 3/32* (2016.01)

(52) U.S. Cl.
CPC ..... *G09G 3/32* (2013.01); *G09G 2300/0426* (2013.01); *G09G 2300/08* (2013.01); *G09G 2310/0264* (2013.01); *G09G 2310/0267* (2013.01); *G09G 2310/08* (2013.01); *G09G 2320/0247* (2013.01); *G09G 2330/02* (2013.01)

(58) Field of Classification Search
CPC ..... G09G 3/32; G09G 2310/08; G09G 2300/0426; G09G 2320/0247; G09G 2330/02; G09G 2300/08; G09G 2310/0267; G09G 2310/0264
See application file for complete search history.

(56) References Cited

U.S. PATENT DOCUMENTS

2011/0164014 A1* 7/2011 Todorovich ..... G09G 3/3466 345/208
2011/0280307 A1* 11/2011 MacInnis ..... H04N 21/42653 375/240.15
2013/0201090 A1* 8/2013 Ohara ..... G09G 3/3677 345/87
2015/0179120 A1* 6/2015 Nakagawa ..... G09G 3/3648 345/204
2015/0269901 A1* 9/2015 Kobayashi ..... G09G 3/3696 345/212
2017/0025061 A1* 1/2017 Takizawa ..... G09G 3/3291
(Continued)

FOREIGN PATENT DOCUMENTS

CN 108878494 A 11/2018

*Primary Examiner* — Andrew Sasinowski
(74) *Attorney, Agent, or Firm* — Miller, Matthias & Hull LLP

(57) ABSTRACT

Disclosed are a display panel, a driving method and a display device. The display panel includes a strobe circuit, a pixel driving circuit and a light-emitting element; the pixel driving circuit includes a first initialization unit, a driving module, and a first light-emitting control unit; the strobe circuit is electrically connected to an initialization signal end; and the first initialization unit is electrically connected between the initialization signal end and an anode of the light-emitting element; in a write frame, the first initialization unit is configured to provide a first initialization voltage signal Vref1 to the anode of the light-emitting element under the control of a first scan signal; and in a hold frame, the first initialization unit is configured to provide a second initialization voltage signal Vref2 to the anode of the light-emitting element under the control of the first scan signal.

20 Claims, 24 Drawing Sheets

(56) References Cited

U.S. PATENT DOCUMENTS

| | | | | |
|---|---|---|---|---|
| 2018/0068615 | A1* | 3/2018 | Imai | G09G 3/3225 |
| 2019/0196618 | A1* | 6/2019 | Lee | G09G 3/3677 |
| 2021/0005138 | A1* | 1/2021 | Umezawa | G09G 3/3233 |

* cited by examiner

DISPLAY PANEL, DRIVING METHOD AND DISPLAY DEVICE

CROSS-REFERENCE TO RELATED APPLICATIONS

This application claims priority to Chinese patent application No. CN202010622533.9 filed with CNIPA on Jun. 30, 2020, the disclosure of which is incorporated herein by reference in its entirety.

TECHNICAL FIELD

Embodiments of the present disclosure relate to the field of display technology, and particularly to a display panel, a driving method and a display device.

BACKGROUND

With the development of display technology, organic light-emitting display panels have become mainstream display panels by virtue of advantages of low power consumption, high response speed and the like thereof, and are widely used in an electronic equipment such as mobile phones, laptops, and computers.

How to reduce power consumption has always been a major research hotspot in the display field, and a wide variety of ways to reduce the power consumption have emerged. In some cases, one way to reduce a driving frequency has a significant effect on reducing the power consumption. Specifically, the display panel includes a normal driving mode and a low-frequency driving mode. When a dynamic picture is displayed, the normal driving mode may be adopted, in which the driving frequency is relatively high, such as 60 Hz, and each frame is a write frame in which a data voltage is written into a sub-pixel. When a static picture is displayed, the low-frequency driving mode may be adopted, in which the driving frequency is relatively low, such as 1 Hz, then 1 write frame and 59 hold frames are included within 1 second. The difference between the hold frames and the write frame is that the hold frames hold a data voltage written by the previous write frame without writing a new data voltage into the sub-pixel. In this way, the effect of reducing the power consumption may be achieved.

However, due to the difference between the hold frames and the write frame, there is a brightness difference between the write frame and the hold frame, which causes users to observe a flicker phenomenon.

SUMMARY

The present disclosure provides a display panel, a driving method and a display device.

In one aspect, an embodiment of the present disclosure provides a display panel. The display panel includes a strobe circuit, a pixel driving circuit and a light-emitting element. The pixel driving circuit includes an initialization signal end, a data signal end, a first initialization unit, a driving module, and a first light-emitting control unit. The strobe circuit is electrically connected to the initialization signal end; and the strobe circuit is configured to output a first initialization voltage signal Vref1 and a second initialization voltage signal Vref2 in a time-division manner under the control of a strobe signal. The first initialization unit is electrically connected between the initialization signal end and an anode of the light-emitting element; in a write frame, the first initialization unit is configured to provide the first initialization voltage signal Vref1 to the anode of the light-emitting element under the control of a first scan signal; and in a hold frame, the first initialization unit is configured to provide the second initialization voltage signal Vref2 to the anode of the light-emitting element under the control of the first scan signal. The driving module and a first end of the first light-emitting control unit are electrically connected to a first node, and a second end of the first light-emitting control unit is electrically connected to the anode of the light-emitting element; in the write frame and the hold frame, the first light-emitting control unit is configured to control a driving current generated by the driving module to flow into the light-emitting element under the control of a light-emitting control signal. A time period corresponding to a valid pulse of the first scan signal is within a time period corresponding to an invalid pulse of the light-emitting control signal; in the write frame, the driving module is configured to receive a data voltage signal provided by the data signal end; and in the hold frame, the driving module is configured to not receive the data voltage signal.

In another aspect, an embodiment of the present disclosure further provides a display device. The display device includes the display panel described in any of the first aspect.

In another aspect, an embodiment of the present disclosure further provides a driving method of a display panel, applied to the display panel described in the first aspect, and the driving method includes: the strobe circuit outputs a first initialization voltage signal Vref1 and a second initialization voltage signal Vref2 in a time-division manner under the control of a strobe signal; in a write frame, the first initialization unit provides the first initialization voltage signal Vref1 to the anode of the light-emitting element under the control of the first scan signal; and in a hold frame, the first initialization unit provides the second initialization voltage signal Vref2 to the anode of the light-emitting element under the control of the first scan signal; and in the write frame and the hold frame, the first light-emitting control unit controls a driving current generated by the driving module to flow into the light-emitting element under the control of the light-emitting control signal.

DETAILED DESCRIPTION

Figure 1:
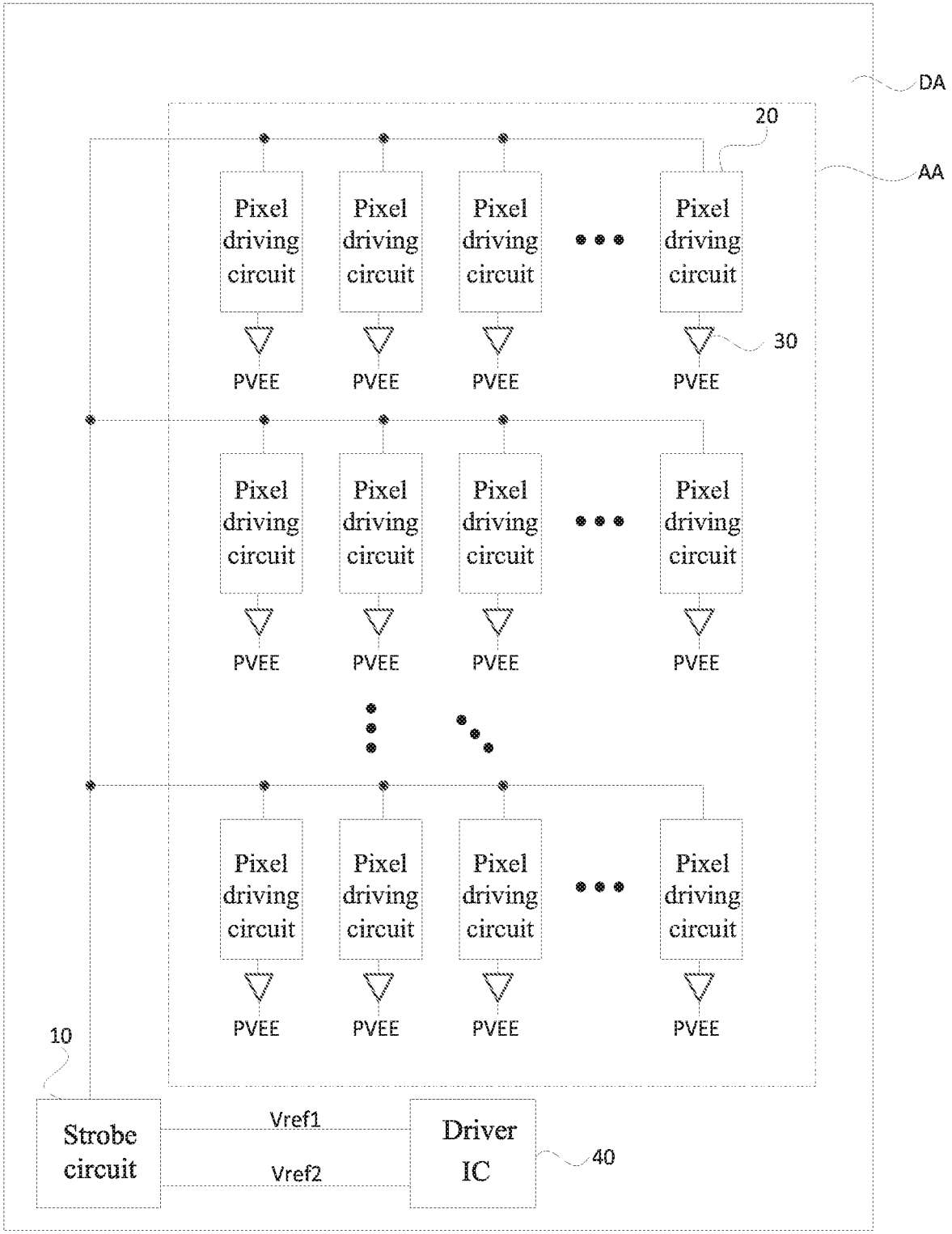
FIG. 1 is a structure diagram of a display panel provided by an embodiment of the present disclosure.

The present disclosure will be further described in detail in conjunction with the drawings and embodiments below. It should be understood that the specific embodiments described herein are merely used for explaining the present disclosure and are not intended to limit the present disclosure. It should also be noted that, for ease of description, only some, but not all, of the structures related to the present disclosure are shown in the drawings.

The brightness difference between a write frame and a hold frame in the related art is caused by the following reason: a pixel driving circuit includes a driving module, a first light-emitting control unit and a first initialization unit; and the driving module and a first end of the first light-emitting control unit are electrically connected to a first node, and a second end of the first light-emitting control unit and the first initialization unit are both electrically connected to an anode of a light-emitting element. Since the write frame and the hold frame are different from each other in whether a data voltage signal is written or not, a voltage at the first node is different at an initial light-emitting moment in the write frame and the hold frame, and thus the time required for changing the voltage at the first node into a gray-scale voltage is different, and finally, the total time for changing the voltage at the first node into the gray scale voltage is different from the total time for changing a voltage of the anode of the light-emitting element into the gray scale voltage, resulting in the brightness difference between the write frame and the hold frame.

In view of this, an embodiment of the present disclosure provides a display panel. The display panel includes a strobe circuit, a pixel driving circuit and a light-emitting element. The pixel driving circuit includes an initialization signal end, a data signal end, a first initialization unit, a driving module, and a first light-emitting control unit.

The strobe circuit is electrically connected to the initialization signal end, and the strobe circuit is configured to output a first initialization voltage signal Vref1 and a second initialization voltage signal Vref2 in a time-division manner under the control of a strobe signal.

The first initialization unit is electrically connected between the initialization signal end and an anode of the light-emitting element; in a write frame, the first initialization unit is configured to provide the first initialization voltage signal Vref1 to the anode of the light-emitting element under the control of a first scan signal; and in a hold frame, the first initialization unit is configured to provide the second initialization voltage signal Vref2 to the anode of the light-emitting element under the control of the first scan signal.

The driving module and a first end of the first light-emitting control unit are electrically connected to a first node, and a second end of the first light-emitting control unit is electrically connected to the anode of the light-emitting element; in the write frame and the hold frame, the first light-emitting control unit is configured to control a driving current generated by the driving module to flow into the light-emitting element under the control of a light-emitting control signal.

A time period corresponding to a valid pulse of the first scan signal is within a time period corresponding to an invalid pulse of the light-emitting control signal; in the write frame, the driving module is configured to receive a data voltage signal provided by the data signal end; and in the hold frame, the driving module is configured to not receive the data voltage signal.

By adopting the above-described technical scheme, different initialization voltage signals are written into the anode of the light-emitting element in the write frame and the hold frame, so that the time required for changing the voltage of the anode of the light-emitting element into a gray-scale voltage (a magnitude of the gray-scale voltage is related to a magnitude of a data voltage) is different at an initial light-emitting moment of the write frame and the hold frame, and thus a difference of the time required for changing a voltage at the first node into the gray-scale voltage at the initial light-emitting moment of the write frame and the hold frame is compensated, and finally, the total time for changing the voltage at the first node into the gray-scale voltage and the total time for changing the voltage of the anode of the light-emitting element into the gray-scale voltage are similar or even the same at the initial light-emitting moment of the write frame and the hold frame, so that a brightness difference between the write frame and the hold frame is reduced, and the large brightness difference between the write frame and the hold frame is alleviated, and thus the effects of improving the flicker and improving the display quality are achieved.

The above contents are the core idea of the present application. The technical schemes in the embodiments of the present disclosure will be clearly and completely described below in conjunction with the drawings in the embodiments of the present disclosure, and apparently, the described embodiments are merely a part of, but not all, the embodiments of the present disclosure. Based on the embodiments of the present disclosure, all other embodiments obtained by those of ordinary skill in the art on the premise of without inventive effort shall fall within the scope of protection of the present disclosure.

Figure 2:
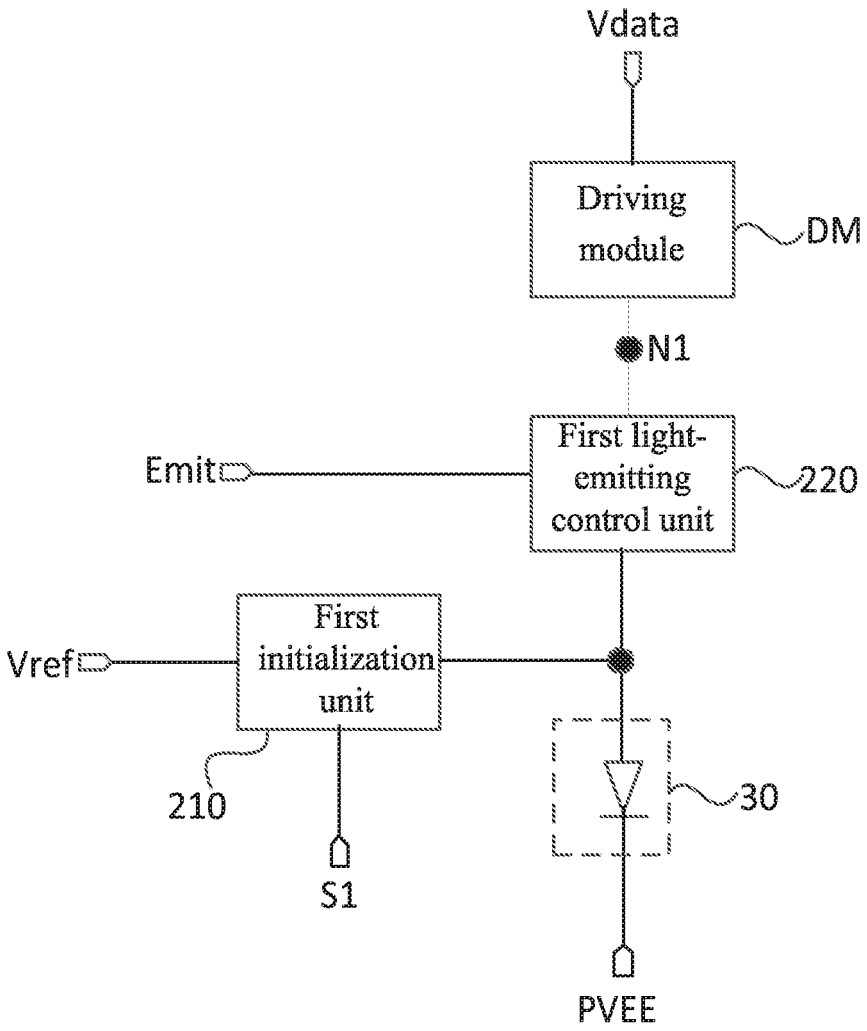
FIG. 2 is a block diagram of a pixel driving circuit provided by an embodiment of the present disclosure.
Figure 3:
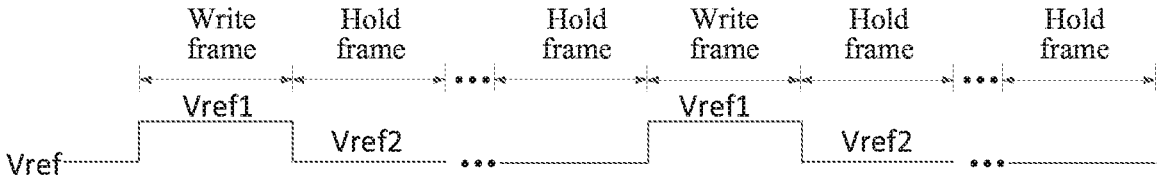
FIG. 3 is a timing diagram of a signal of an initialization signal end provided by an embodiment of the present disclosure.

FIG. 1 is a structure diagram of a display panel provided by an embodiment of the present disclosure. FIG. 2 is a block diagram of a pixel driving circuit provided by an embodiment of the present disclosure. FIG. 3 is a timing diagram of a signal of an initialization signal end provided by an embodiment of the present disclosure. Referring to FIGS. 1 to 3, the display panel includes a strobe circuit 10, a pixel driving circuit 20 and a light-emitting element 30; the pixel driving circuit 20 includes an initialization signal end Vref, a data signal end Vdata, a first initialization unit 210, a driving module DM, and a first light-emitting control unit 220. The strobe circuit 10 is electrically connected to the initialization signal end Vref; and the strobe circuit 10 is configured to output a first initialization voltage signal Vref1 and a second initialization voltage signal Vref2 in a time-division manner under the control of a strobe signal. The first initialization unit 210 is electrically connected between the initialization signal end Vref and an anode of the light-emitting element 30. In a write frame, the first initialization unit 210 is configured to provide the first initialization voltage signal Vref1 to the anode of the light-emitting element 30 under the control of a first scan signal. In a hold frame, the first initialization unit 210 is configured to provide the second initialization voltage signal Vref2 to the anode of the light-emitting element 30 under the control of the first scan signal. The driving module DM and a first end of the first light-emitting control unit 220 are electrically connected to a first node N1, a second end of the first light-emitting control unit 220 is electrically connected to the anode of the light-emitting element 30, and a cathode of the light-emitting element is electrically connected to a second power supply signal end PVEE. In the write frame and the hold frame, the first light-emitting control unit 220 is configured to control a driving current generated by the driving module to flow into the light-emitting element 30 under the control of a light-emitting control signal.

A time period corresponding to a valid pulse of the first scan signal is within a time period corresponding to an invalid pulse of the light-emitting control signal; in the write frame, the driving module DM is configured to receive a data voltage signal provided by the data signal end Vdata; and in the hold frame, the driving module DM is configured to not receive the data voltage signal. It should be noted that the valid pulse described here and hereinafter refers to a pulse in the control signal (e.g., the first scan signal) that turns on a unit (e.g., the first initialization unit) under the control of the control signal. The invalid pulse refers to a pulse in a control signal (e.g., the light-emitting control signal) that turns off a unit (e.g., the first light-emitting control unit) under the control of the control signal.

Specifically, the display panel includes a display area AA and a non-display area DA surrounding the display area AA. The display area AA is provided with multiple sub-pixels. Each of the multiple sub-pixels includes the pixel driving circuit 20 and the light-emitting element 30. The pixel driving circuit 20 is configured to drive the light-emitting element 30 to emit light so as to display image information. The non-display area DA is used for setting a peripheral circuit such as a gate driving circuit and a driver IC 40. The strobe circuit 10 may be arranged in the display area AA, and the strobe circuit 10 may also be arranged in the non-display area DA (as shown in FIG. 1), which is not limited here.

Specifically, the strobe circuit 10 includes a first input end and a second input end. The first input end is configured to receive the first initialization voltage signal Vref1 output by the driver IC 40, and the second input end is configured to receive the second initialization voltage signal Vref2 output by the driver IC 40. The strobe circuit 10 outputs the first initialization voltage signal Vref1 and the second initialization voltage signal Vref2 in the time-division manner under the control of the strobe signal.

It should be understood that if the first initialization voltage signal Vref1 and the second initialization voltage signal Vref2 are to be output in the time-division manner by one pin of the driver IC 40, the architecture of the driver IC 40 needs to be modified, i.e., a new driver IC 40 needs to be developed, which has the disadvantages of high cost and long period. However, it is easier to realize that one pin of the driver IC 40 outputs the first initialization voltage signal Vref1 and another pin of the driver IC 40 outputs the second initialization voltage signal Vref2, and this function may be achieved through an existing driver IC 40. Therefore, the strobe circuit 10 is arranged to select the first initialization voltage signal Vref1 and the second initialization voltage signal Vref2, so that the display panel in the embodiments of the present disclosure is compatible with the driver IC 40 in the related art, thereby the research and development cycle of a display device including the display panel is shortened, and the research and development cost is reduced.

Specifically, the initialization signal end Vref of the pixel driving circuit 20 is configured to receive the initialization voltage signal (the first initialization voltage signal Vref1 or the second initialization voltage signal Vref2) output by the strobe circuit 10. The data signal end Vdata is configured to receive the data voltage signal. In the write frame, the driving module DM is configured to receive the data voltage signal provided by the data signal end Vdata, and the data voltage signal is written into the sub-pixels; in the hold frame, the driving module DM is configured to not receive the data voltage signal, and keep a data voltage signal written into by a write frame closest to the driving module DM in the time, and not write a new data voltage signal.

Specifically, for each pixel driving circuit 20, in the time period corresponding to the valid pulse of the first scan signal, the first initialization unit 210 is turned on, and the initialization voltage signal (the first initialization voltage signal Vref1 or the second initialization voltage signal Vref2) of the initialization signal end Vref is transmitted to the anode of the light-emitting element 30 through the first initialization unit 210, so as to reset the anode of the light-emitting element 30. The driving module DM is configured to generate a driving current according to the data voltage signal. In a time period corresponding to a valid level of the light-emitting control signal, the first light-emitting control unit 220 is turned on, and the driving current flows into the light-emitting element 30 through the first light-emitting control unit 220 to drive the light-emitting element 30 to emit light. It should be noted that the valid level described here refers to a level of the control signal (e.g., the first scan signal) that turns on a unit (e.g., the first initialization unit) under the control of the control signal. In addition, the specific implementation form of the pixel driving circuit 20 may be set by those skilled in the art according to the actual situation, and is not limited here.

It should be noted that FIG. 3 only exemplarily shows that the strobe module outputs the first initialization voltage signal Vref1 during the entire write frame, and outputs the second initialization voltage signal Vref2 in the whole hold frame, but it is not a limitation of the present application. A timing sequence of the initialization signal output by the strobe module may be set by those skilled in the art according to the actual situation, so long as following conditions are satisfied: for each pixel driving circuit 20, the first initialization voltage signal Vref1 is output in the time period corresponding to the valid pulse of the first scan signal in the write frame, and the second initialization voltage signal Vref2 is output in a time period corresponding to a pulse of a second scan signal in the hold frame.

It should be understood that, for each pixel driving circuit 20, at an initial moment when the light-emitting control signal jumps to the valid level, a voltage at the first node N1 changes into a gray-scale voltage (matching the driving current), and a voltage of the anode of the light-emitting element 30 changes from the initialization voltage signal into the gray-scale voltage. By writing different initialization voltage signals to the anode of the light-emitting element 30 in the write frame and the hold frame, the difference in the time required for changing the voltage at the first node N1 into the gray-scale voltage in the write frame and the hold frame may be compensated, so that in the write frame and the hold frame, the total time for changing the voltage at the first node N1 into the gray-scale voltage and the total time for changing the voltage of the anode of the light-emitting element 30 into the gray-scale voltage is similar or even the same, and thus the brightness difference between the write frame and the hold frame is reduced, the large brightness difference between the write frame and the hold frame is alleviated, and the effects of improving the flicker and improving the display quality are achieved.

In an embodiment, in the write frame, a voltage at the first node N1 at an initial light-emitting moment is V1; and in the hold frame, a voltage at the first node N1 at the initial light-emitting moment is V2; $(V1-V2)*(Vref2-Vref1)>0$.

Specifically, the time required for changing from V1 into the gray-scale voltage is t1, and the time required for changing from V2 into the gray-scale voltage is t2; the time required for changing from the Vref1 into the gray-scale voltage is t3, and the time required for changing from the Vref2 into the gray-scale voltage is t4. When $V1>V2$ and $t1<t2$, $t3>t4$ may be achieved by setting $Vref1<Vref2$, and finally $t1+t3$ and $t2+t4$ are the same or similar. When $V1<V2$ and $t1>t2$, $t3<t4$ may be achieved by setting $Vref1>Vref2$, and finally $t1+t3$ and $t2+t4$ are the same or similar.

It should be noted that on the basis of $(V1-V2)*(Vref2-Vref1)>0$, specific values of the first initial voltage signal Vref1 and the second initial voltage signal Vref2 may be set by those skilled in the art according to the actual situation, and are not limited here.

On the basis of the above-described technical scheme, specifically, there are various positions at which the strobe circuit 10 is arranged, and a typical example will be described below, but it is not a limitation of the present application.

With continued reference to FIG. 1, in an embodiment, the display panel includes the display area AA and the non-display area DA surrounding the display area AA, and the strobe circuit 10 is located in the non-display area DA. In this way, the display area AA does not need to reserve space for the strobe circuit 10 to ensure a larger aperture opening ratio of the sub-pixels. It should be noted that specific position of the strobe circuit 10 in the non-display area DA may be set by those skilled in the art according to the actual situation, and is not limited here.

With continued reference to FIG. 1, in an embodiment, the display panel includes multiple pixel driving circuits 20 and one strobe circuit 10; the initialization signal end Vref of each pixel driving circuit 20 is electrically connected to the strobe circuit 10. In this way, the space required to be reserved for the strobe circuit 10 by the non-display area DA is small, the area of the non-display area is favorably reduced, and the high screen-to-body ratio is realized.

Figure 4:
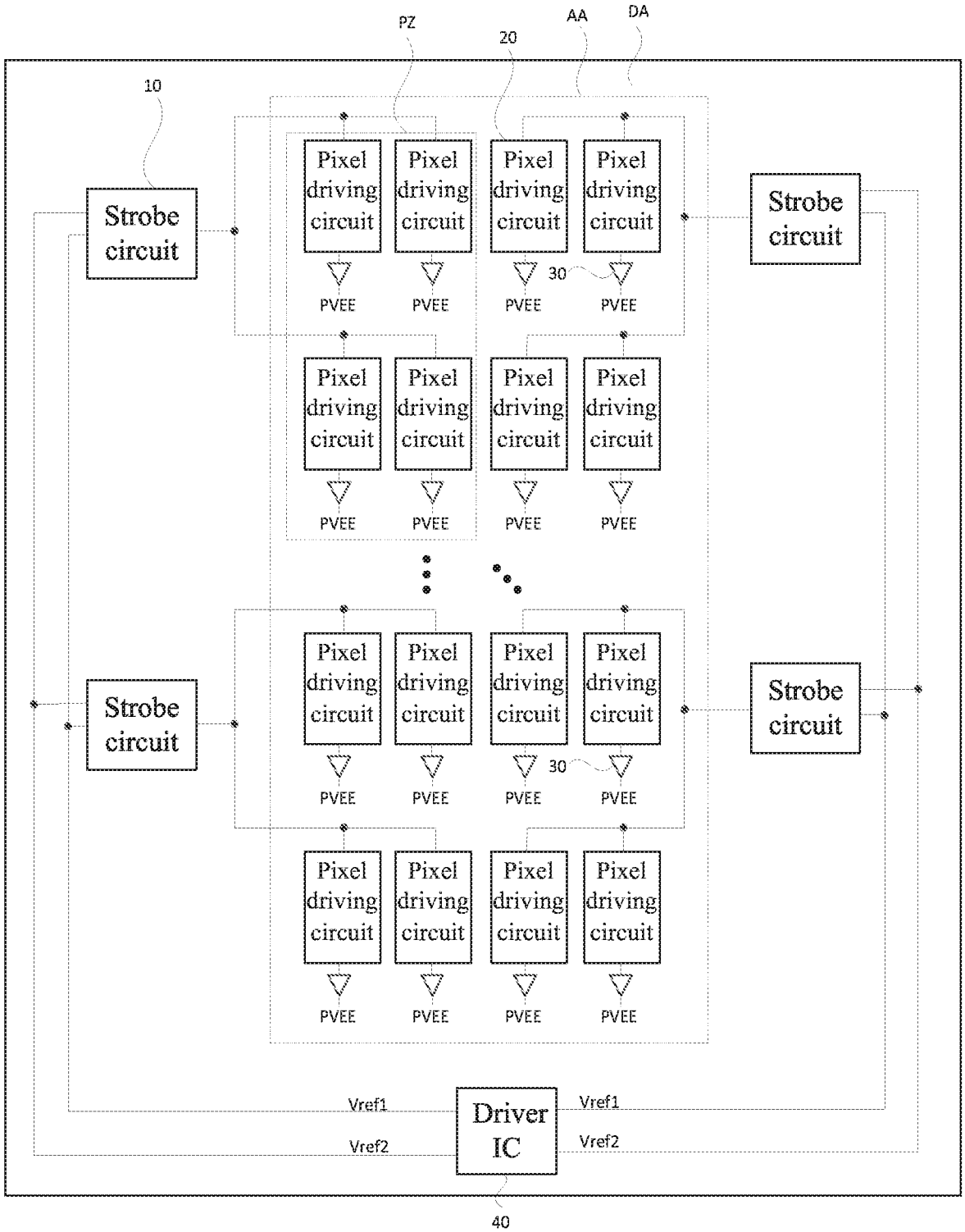
FIG. 4 is a structure diagram of another display panel provided by an embodiment of the present disclosure.

FIG. 4 is a structure diagram of another display panel provided by an embodiment of the present disclosure. Referring to FIG. 4, in an embodiment, the display panel includes multiple pixel driving circuits 20 and multiple strobe circuits 10. The pixel driving circuits 20 may be divided into multiple pixel driving circuit groups PZ, each pixel driving circuit group PZ includes at least two pixel driving circuits 20, and the pixel driving circuits 20 in each pixel driving circuit group PZ are electrically connected to a same strobe circuit 10. In this way, when one or more of the strobe circuits 10 fails due to continuous output of one initialization voltage signal, other strobe circuits 10 will continue to work, that is, the pixel driving circuits 20 in each pixel driving circuit group PZ are arranged to be electrically connected to a same strobe circuit 10, so that the degree of influence on the display effect when one strobe circuit 10 fails may be reduced.

It should be noted that the division of the pixel driving circuit group PZ may be set by those skilled in the art according to the actual situation, and is not limited here.

Figure 5:
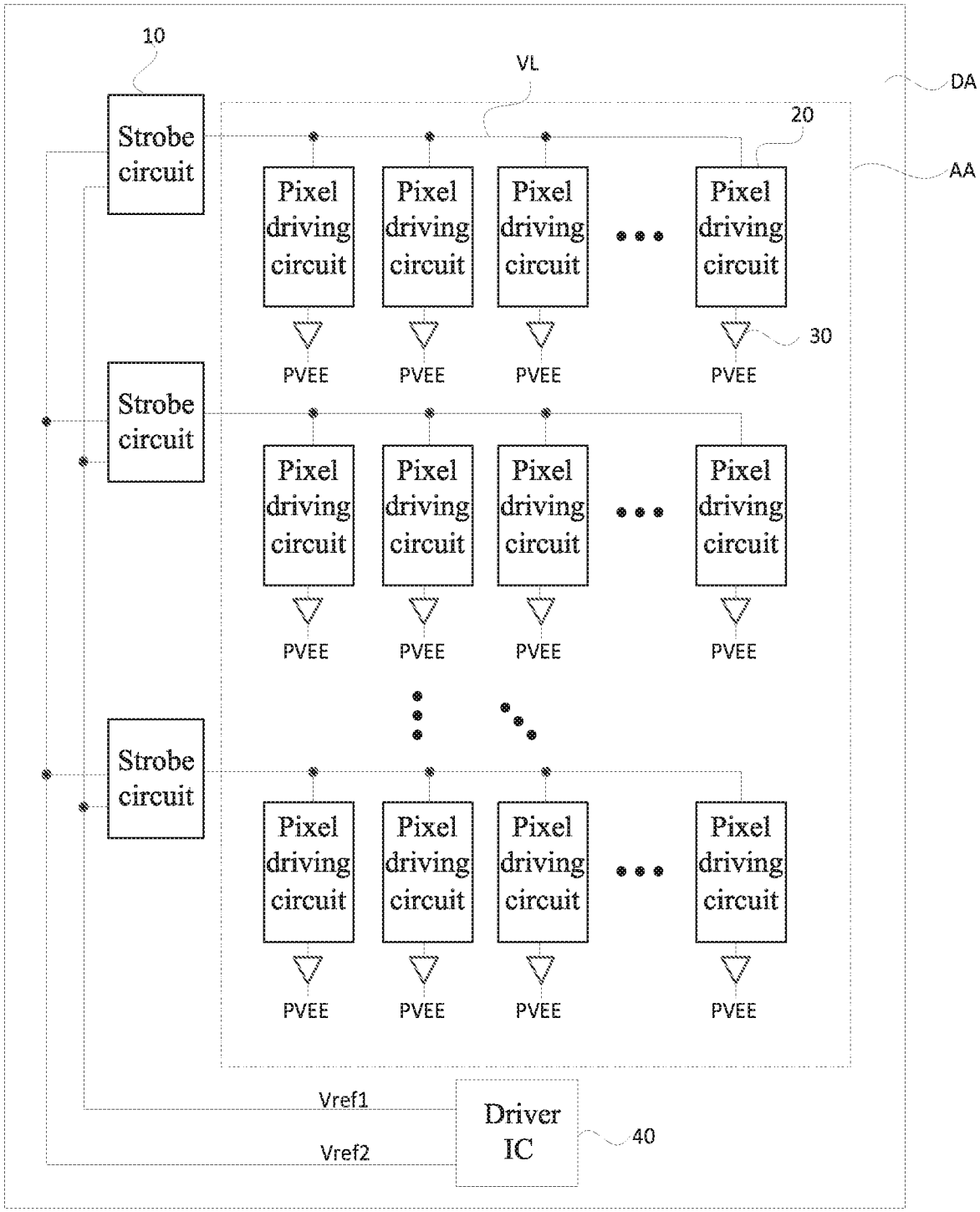
FIG. 5 is a structure diagram of still another display panel provided by an embodiment of the present disclosure.
Figure 6:
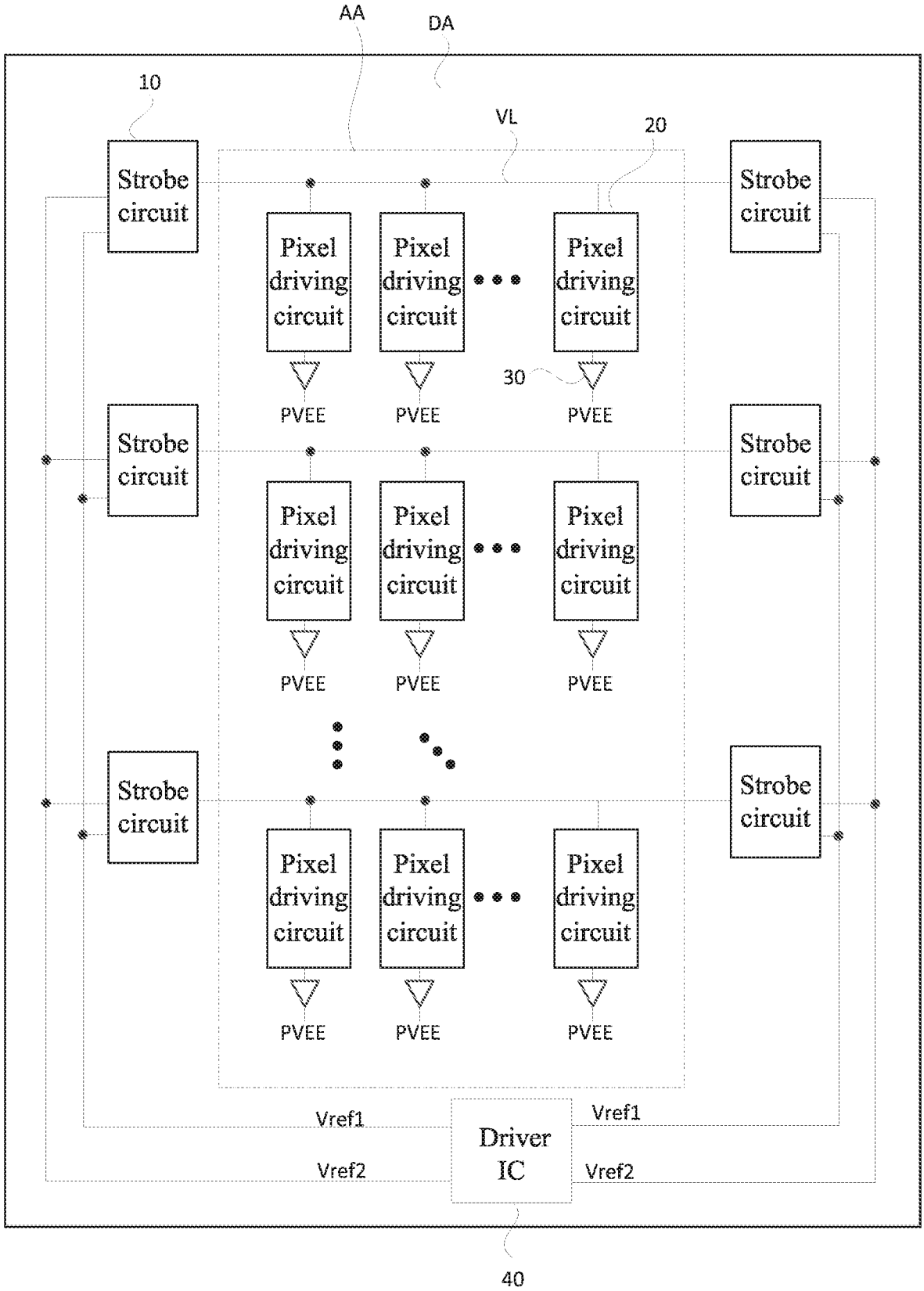
FIG. 6 is a structure diagram of yet another display panel provided by an embodiment of the present disclosure.

FIG. 5 is a structure diagram of still another display panel provided by an embodiment of the present disclosure. FIG. 6 is a structure diagram of yet another display panel provided by an embodiment of the present disclosure. Referring to FIGS. 5 and 6, in an embodiment, the display panel includes multiple pixel driving circuits 20 and multiple strobe circuits 10. The pixel driving circuits 20 are arranged in an array; initialization signal ends Vref of pixel driving circuits 20 in each row are electrically connected to a same strobe circuit 10.

With continued reference to FIG. 5, in an embodiment, the initialization signal ends Vref of the pixel driving circuits 20 in each row are electrically connected to a same strobe circuit 10; that is, the initialization signal ends Vref of pixel driving circuits 20 in each row are electrically connected to a same initialization signal line VL, and one end of each initialization signal line VL is connected to one strobe circuit 10. In this way, when each strobe circuit 10 corresponds to a different strobe signal, a timing sequence of a first initialization voltage signal Vref1 and a second initialization voltage signal Vref2 received by the pixel driving circuits 20 in each row may be flexibly set. Moreover, when one or more of the strobe circuits 10 fail due to continuous output of one initialization voltage signal, other strobe circuits 10 will continue to work. Compared with the related art, the brightness difference between the write frame and the hold frame can be alleviated.

With continued reference to FIG. 6, in an embodiment, the initialization signal ends Vref of the pixel driving circuits 20 in each row are electrically connected to a same initialization signal line VL, and each initialization signal line VL is connected to at least two strobe circuits 10. Exemplarily, each of the two ends of each initialization signal line VL is connected to one respective strobe circuit 10, as shown in FIG. 6. In this way, a voltage drop of the initialization voltage signal (the first initialization voltage signal Vref1 or the second initialization voltage signal Vref2) on the initialization signal line VL may be reduced, and the difference among the initialization voltage signals received by the pixel driving circuits 20 in a same row may be reduced, the uniformity is improved, and the display effect is further improved.

Figure 7:
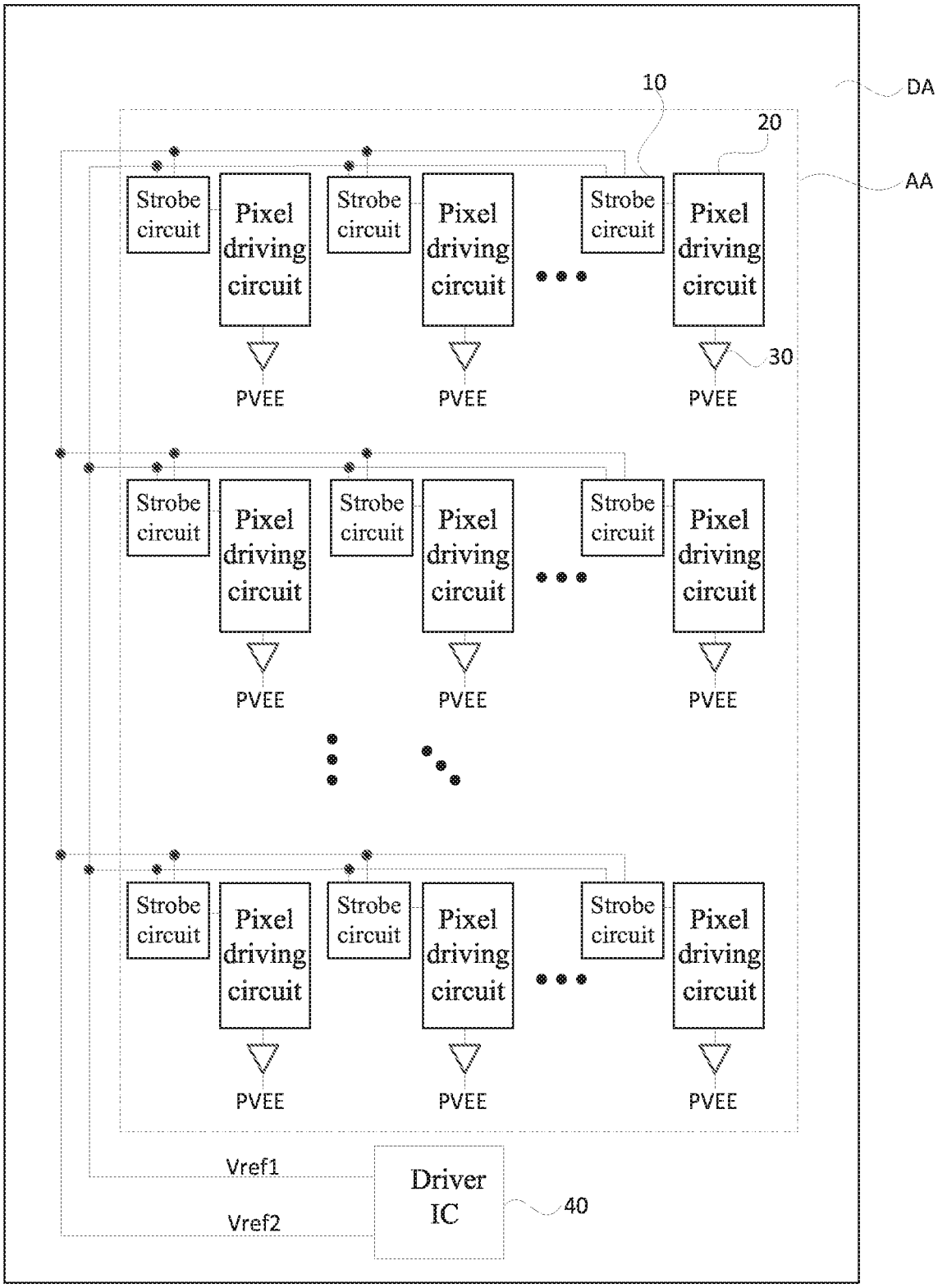
FIG. 7 is a structure diagram of a display panel provided by an embodiment of the present disclosure.

FIG. 7 is a schematic diagram of a display panel provided by an embodiment of the present disclosure. Referring to FIG. 7, in an embodiment, the display panel includes multiple pixel driving circuits 20 and multiple strobe circuits 10, and each of the multiple strobe circuits 10 is electrically connected to a respective one of the multiple pixel driving circuits 20.

With continued reference to FIG. 7, the multiple strobe circuits 10 are located in the display area AA, and an output end of each strobe circuit 10 is electrically connected to an initialization signal end Vref of one of the pixel driving circuits 20. In an embodiment, a same row of strobe circuits 10 may be controlled by a same strobe signal, so that the control of the strobe circuits 10 may be simplified.

It should be understood that when one or more of the multiple strobe circuits 10 fail due to continuous output of one initialization voltage signal in failure, other strobe circuits 10 will continue to work. Compared with the related art, the brightness difference between the write frame and the hold frame can be alleviated. Moreover, the failure of each of the multiple strobe circuits 10 only affects one pixel driving circuit 20, that is, the failure of one strobe circuit 10 has little impact on the display effect of the display panel, which is conductive to improving the stability of the display quality and prolonging the service life of the display panel.

It should be noted that FIG. 1, FIG. 4, and FIG. 7 only exemplarily show that the multiple pixel driving circuits 20 are arranged in a matrix, but it is not a limitation of the present application, and it may be set by those skilled in the art according to the actual situation.

Specifically, there are various specific implementation forms of the strobe circuit 10, and a typical example will be described below, but it is not a limitation of the present application.

Figure 8:
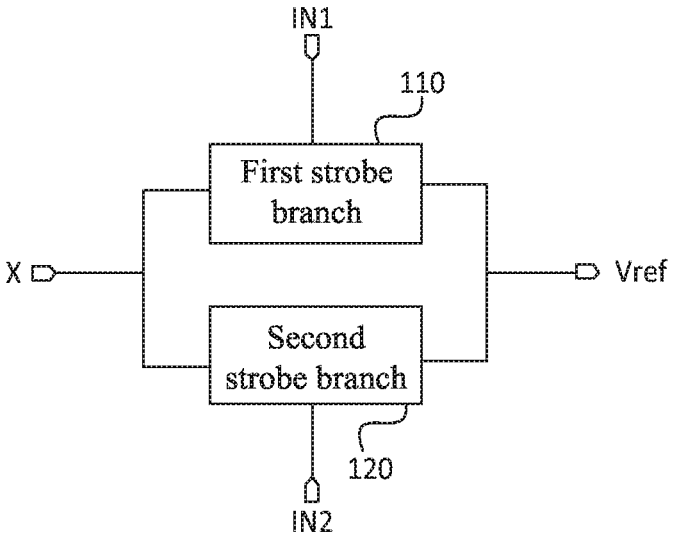
FIG. 8 is a structure diagram of a strobe circuit provided by an embodiment of the present disclosure.

FIG. 8 is a structure diagram of a strobe circuit provided by an embodiment of the present disclosure. Referring to FIG. 8, in an embodiment, the strobe circuit 10 includes a first input end IN1, a second input end IN2, a first strobe branch 110, and a second strobe branch 120. The first input end IN1 is configured to receive a first initialization voltage signal Vref1. The first strobe branch 110 is electrically connected between the first input end IN1 and an initialization signal end Vref, and the first strobe branch 110 is configured to provide the first initialization voltage signal Vref1 to the initialization signal end Vref under the control of a strobe signal. The second input end IN2 is configured to receive a second initialization voltage signal Vref2. The second strobe branch 120 is electrically connected between the second input end IN2 and the initialization signal end Vref, and the second strobe branch 120 is configured to provide the second initialization voltage signal Vref2 to the initialization signal end Vref under the control of the strobe signal.

In an embodiment, with continued reference to FIG. 8, the strobe circuit 10 further includes a strobe signal input end X, the strobe signal input end X is electrically connected to a control end of the first strobe branch 110 and a control end of the second strobe branch 120, respectively. The strobe signal input end X is configured to receive the strobe signal from the outside, and the first strobe branch 110 and the second strobe branch 120 are turned on in a time-division manner under the control of a same strobe signal, so as to output the first initialization voltage signal Vref1 and the second initialization voltage signal Vref2 in the time-division manner for the initialization signal end Vref. It should be noted that the specific implementation forms of the first strobe branch 110 and the second strobe branch 120 may be set by those skilled in the art according to the actual situation, and is not limited here.

Figure 9:
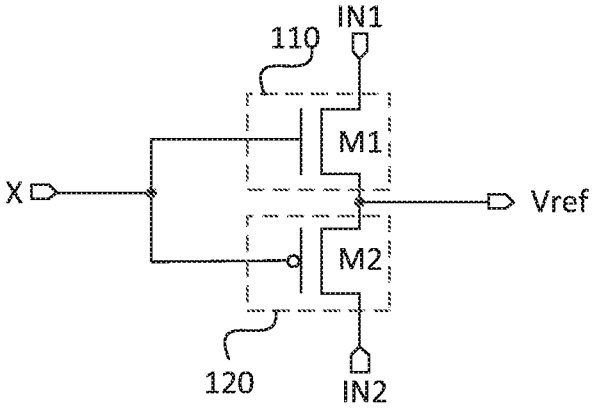
FIG. 9 is a diagram of a circuit element of a strobe circuit provided by an embodiment of the present disclosure.

FIG. 9 is a diagram of a circuit element of a strobe circuit provided by an embodiment of the present disclosure. Referring to FIG. 9, in an embodiment, the first strobe branch 110 includes a first transistor M1, and the second strobe branch 120 includes a second transistor M2; the first transistor M1 is a P-type transistor, and the second transistor M2 is an N-type transistor; or, the first transistor M1 is an N-type transistor, and the second transistor M2 is a P-type transistor (as shown in FIG. 9); a control end of the first transistor M1 and a control end of the second transistor M2 are both configured to receive a strobe signal.

In an embodiment, both the control end of the first transistor M1 and the control end of the second transistor M2 are electrically connected to a strobe signal input end X. When the first transistor M1 is an N-type transistor and the second transistor M2 is a P-type transistor, the first transistor M1 is turned on when the strobe signal is at a high level, and the second transistor M2 is turned on when the strobe signal is at a low level. When the first transistor M1 is a P-type transistor and the second transistor M2 is an N-type transistor, the first transistor M1 is turned on when the strobe signal is at the low level, and the second transistor M2 is turned on when the strobe signal is at the high level.

It should be understood that, since the strobe circuit 10 is arranged to include two transistors, the structure of the strobe circuit 10 is simple, which is conductive to reducing the space occupied by the strobe circuit 10, and realizing a narrow frame or a high aperture opening ratio.

Figure 10:
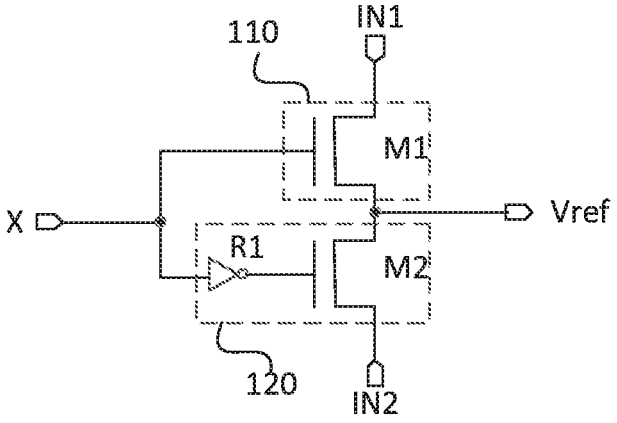
FIG. 10 is a diagram of a circuit element of another strobe circuit provided by an embodiment of the present disclosure.

FIG. 10 is a diagram of a circuit element of another strobe circuit provided by an embodiment of the present disclosure. Referring to FIG. 10, in an embodiment, the first strobe branch 110 includes a first transistor M1, the second strobe branch 120 includes a second transistor M2 and a first inverter R1; the first transistor M1 and the second transistor M2 are of a same type, a control end of the first transistor M1 and a control end of the second transistor M2 are both configured to receive a strobe signal.

Specifically, both the control end of the first transistor M1 and the control end of the second transistor M2 are electrically connected to a strobe signal input end X. When the first transistor M1 and the second transistor M2 are N-type transistors (as shown in FIG. 10), the first strobe branch 110 is turned on when the strobe signal is at a high level, and the second strobe branch 120 is turned on when the strobe signal is at a low level. When the first transistor M1 and the second transistor M2 are P-type transistors, the first strobe branch 110 is turned on when the strobe signal is at the low level, and the second strobe branch 120 is turned on when the strobe signal is at the high level.

It should be understood that, since the first transistor M1 and the second transistor M2 are arranged to be of a same type, these two transistors may be formed using a same manufacturing process, which is conductive to simplifying the manufacturing process of the strobe circuit 10, and thus improving the manufacturing efficiency and reducing the cost.

In an embodiment, there are various specific implementation forms of the pixel driving circuit 20, and a typical example will be described below, but it is not a limitation of the present application.

Figure 11:
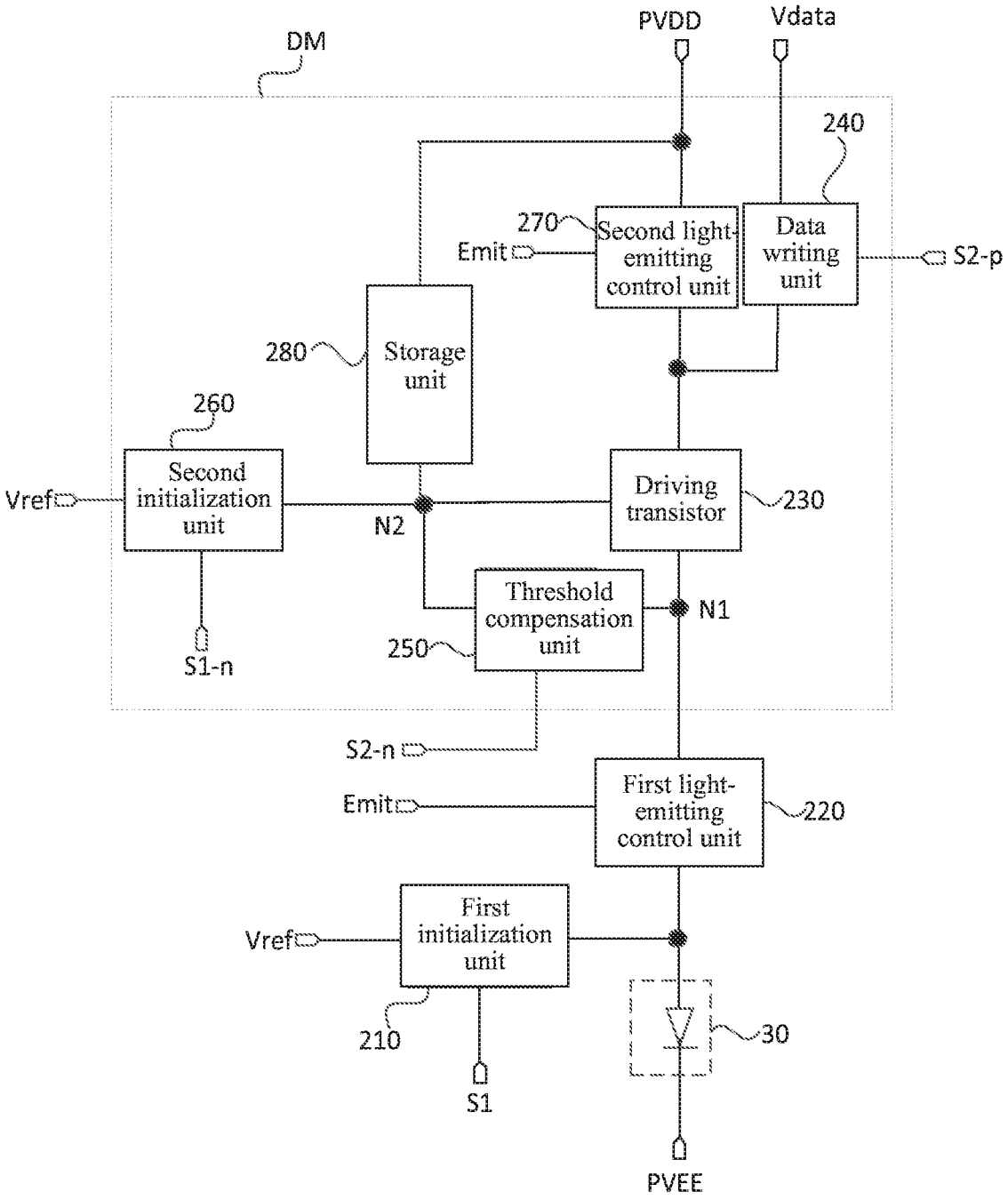
FIG. 11 is a block diagram of another pixel driving circuit provided by an embodiment of the present disclosure.

FIG. 11 is a block diagram of another pixel driving circuit provided by an embodiment of the present disclosure. Referring to FIG. 11, in an embodiment, the pixel driving circuit 20 includes a first power supply signal end PVDD, a first scan signal end 51 for receiving a first scan signal, a second scan signal end S1-*n* for receiving a second scan signal, a third scan signal end S2-*p* for receiving a third scan signal, a fourth scan signal end S2-*n* for receiving a fourth scan signal, and a light-emitting control signal end Emit for receiving a light-emitting control signal. The driving module DM includes a storage unit 280, a driving transistor 230, a data writing unit 240, a threshold compensation unit 250, a second initialization unit 260, and a second light-emitting control unit 270.

Specifically, the second initialization unit 260 is electrically connected between a initialization signal end Vref and a second node N2; in a write frame, the second initialization unit 260 is configured to provide a first initialization voltage signal Vref1 to the second node N2 under the control of the second scan signal.

In an embodiment, a control end of the driving transistor 230 and a first end of the storage unit 280 are electrically connected to the second node N2; a second end of the storage unit 280 is electrically connected to the first power supply signal end PVDD; the data writing unit 240 is electrically connected between a data signal end Vdata and a first electrode of the driving transistor 230; the threshold compensation unit 250 is electrically connected between a second electrode of the driving transistor 230 and the second node N2. In the write frame, the data writing unit 240 is configured to provide a data voltage signal to the second node N2 under the control of the third scan signal, and the threshold compensation unit 250 is configured to compensate a threshold voltage of the driving transistor 230 to the second node N2 under the control of the fourth scan signal.

In an embodiment, the second light-emitting control unit 270 is electrically connected between a first power supply signal end PVDD and the first electrode of the driving transistor 230. In the write frame and a hold frame, the second light-emitting control unit 270 is configured to write a first power supply voltage signal into the first electrode of the driving transistor 230 under the control of the light-emitting control signal, the driving transistor 230 is configured to generate a driving current according to the data voltage signal, and the first light-emitting control unit 220 is configured to flow the driving current into the light-emitting element 30 under the control of the light-emitting control signal.

Figure 12:
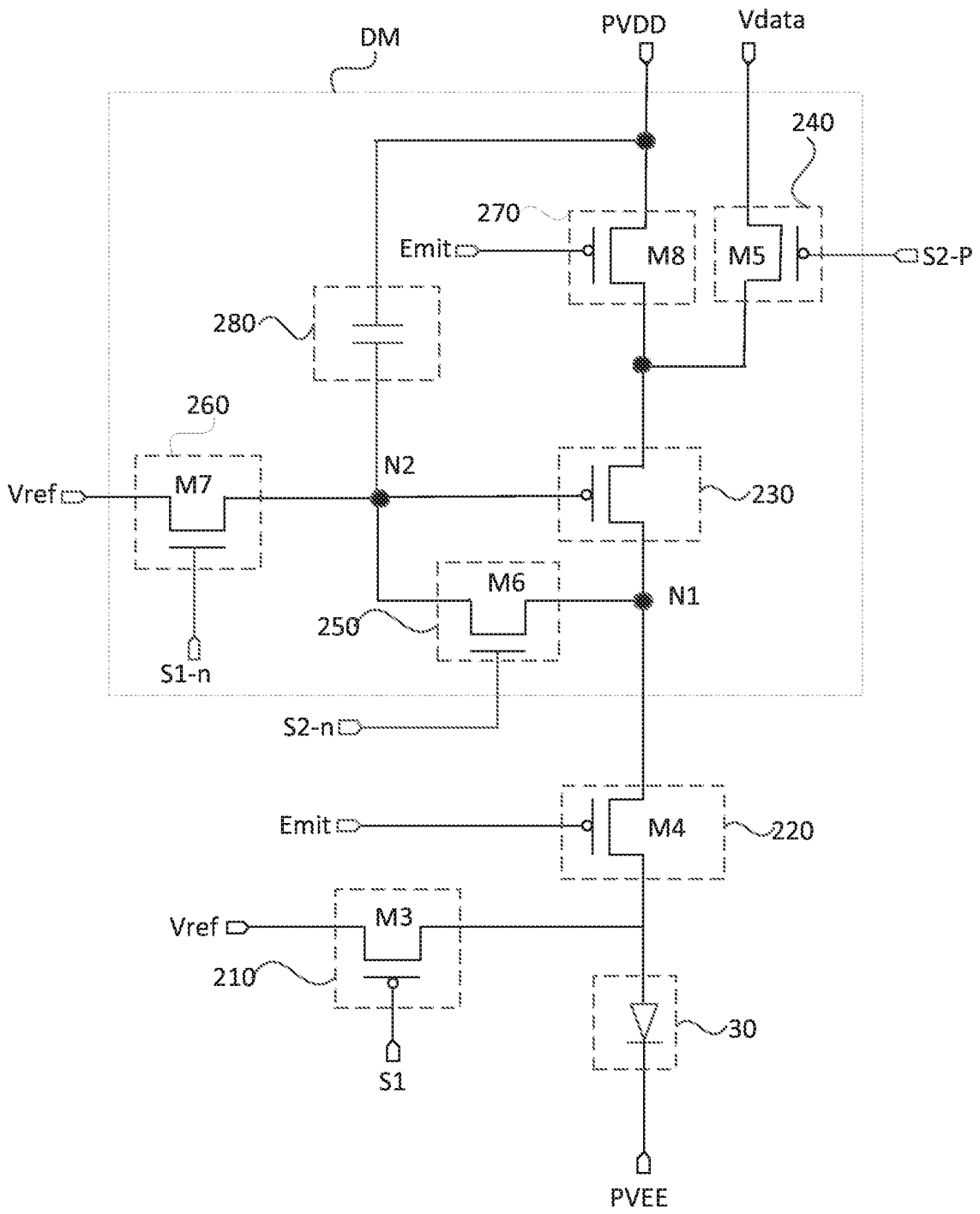
FIG. 12 is a diagram of a circuit element of a pixel driving circuit provided by an embodiment of the present disclosure.

In an embodiment, FIG. 12 is a diagram of a circuit element of a pixel driving circuit provided by an embodiment of the present disclosure. Referring to FIG. 12, the first initialization unit 210 includes a third transistor M3, a first electrode of the third transistor M3 is electrically connected to an initialization signal end Vref, a second electrode of the third transistor M3 is electrically connected to an anode of a light-emitting element 30, and a control end of the third transistor M3 is electrically connected to a first scan signal end S1. The first light-emitting control unit 220 includes a fourth transistor M4, a first electrode of the fourth transistor M4 is electrically connected to a second electrode of a driving transistor 230, a second electrode of the fourth transistor M4 is electrically connected to the anode of the light-emitting element 30, and a control end of the fourth transistor M4 is electrically connected to a light-emitting control signal end Emit. The data writing unit 240 includes a fifth transistor M5, a first electrode of the fifth transistor M5 is electrically connected to a data signal end Vdata, a second electrode of the fifth transistor M5 is electrically connected to a first electrode of the driving transistor 230, and a control end of the fifth transistor M5 is electrically connected to the third scan signal end S2-*p*. The threshold compensation module includes a sixth transistor M6, a first electrode of the sixth transistor M6 is electrically connected to a control end of the driving transistor 230, a second electrode of the sixth transistor M6 is electrically connected to the second electrode of the driving transistor 230, and a control end of the sixth transistor M6 is electrically connected to the fourth scan signal end S2-*n*. The second initialization unit 260 includes a seventh transistor M7, a first electrode of the seventh transistor M7 is electrically connected to the initialization signal end Vref, a second electrode of the seventh transistor M7 is electrically connected to the control end of the driving transistor 230, and a control end of the seventh transistor M7 is electrically connected to a second scan signal end S1-*n*. The second light-emitting control unit 270 includes an eighth transistor M8, a first electrode of the eighth transistor M8 is electrically connected to a first power supply signal end PVDD, a second electrode of the eighth transistor M8 is electrically connected to the first electrode of the driving transistor 230, a control end of the eight transistor M8 is electrically connected to the light-emitting control signal end Emit. The storage unit 280 includes a capacitor, a first end of the capacitor is electrically connected to the first power supply signal end PVDD, and a second end of the capacitor is electrically connected to the control end of the driving transistor 230.

In an embodiment, transistors in the threshold compensation unit 250 and the second initialization unit 260 are semiconductor oxide transistors. Exemplarily, the transistors in the threshold compensation unit 250 and the second initialization unit 260 are indium gallium zinc oxide transistors. Exemplarily, referring to FIG. 12, the sixth transistor M6 and the seventh transistor M7 are indium gallium zinc oxide transistors.

It should be understood that a leakage current of the semiconductor oxide transistor is relatively small, which is conductive to stabilizing a voltage of the second node N2, and thus stabilizing a driving current generated by the driving transistor 230, and is conductive to improving the uniformity of the light-emitting brightness of the light-emitting element 30.

Figure 13:
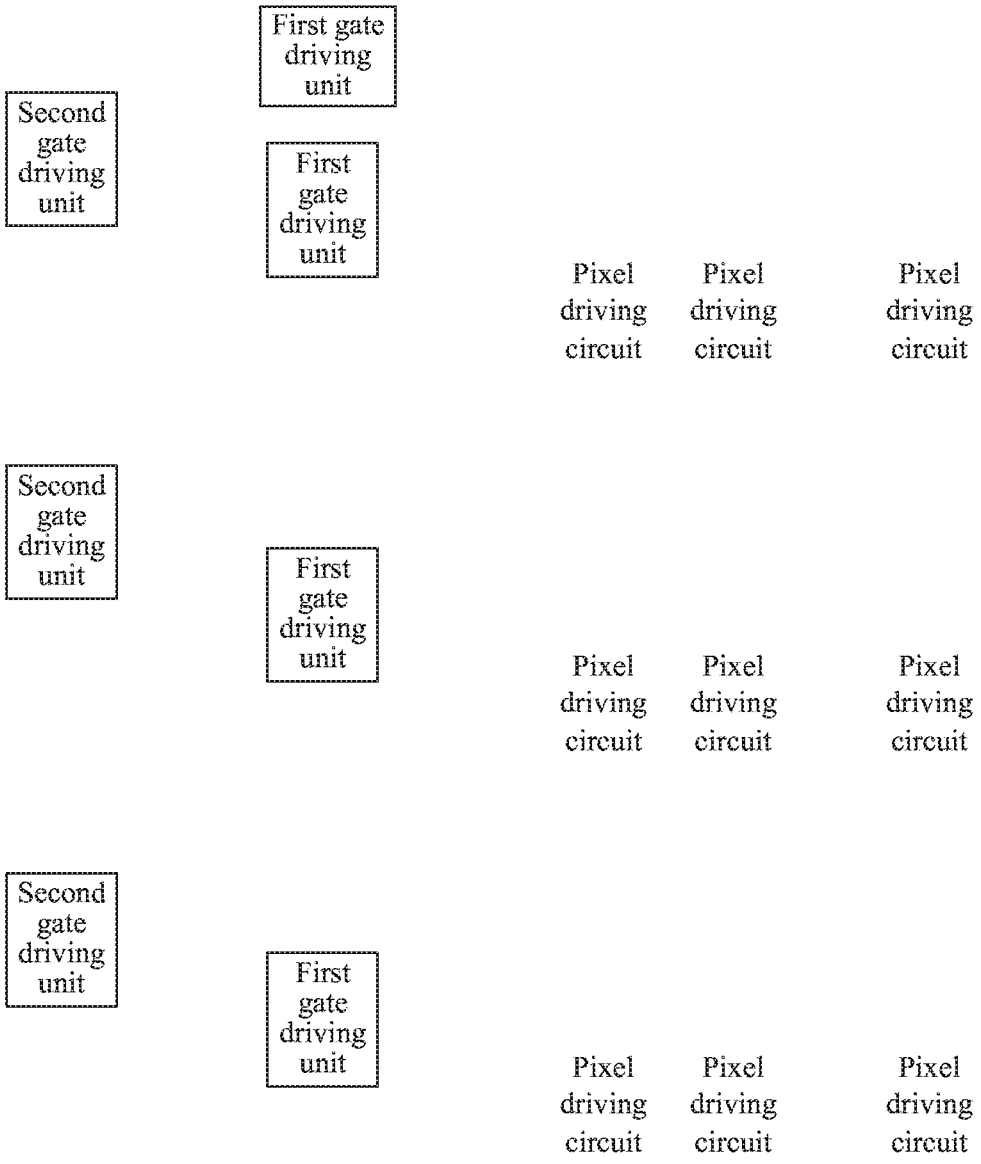
FIG. 13 is a structure diagram of another display panel provided by an embodiment of the present disclosure.

FIG. 13 is a structure diagram of another display panel provided by an embodiment of the present disclosure. Referring to FIG. 13, the display panel includes N rows of pixel driving circuits 20, a first gate driving circuit 51, a second gate driving circuit 52, and a light-emitting control circuit (not shown in FIG. 13). The first gate driving circuit 51 includes first gate driving units cascaded in N+1 stages (from the 0th stage to the N-th stage), an input end of the first gate driving unit in one stage being electrically connected to an output end of the first gate driving unit in the previous stage. The second gate driving circuit includes second gate driving units cascaded in N stages (from the 1st stage to the N-th stage), an input end of the second gate driving unit in one stage being electrically connected to an output end of the second gate driving unit in the previous stage. The light-emitting control circuit includes light-emitting control units cascaded in N stages (from the 1st stage to the N-th stage), an input end of the light-emitting control unit in one stage being electrically connected to an output end of the light-emitting control unit in the previous stage, and N is an integer larger than or equal to 2.

With continued reference to FIGS. 11 to 13, specifically, the exact circuit in the display panel, to which the first scan signal end 51 in the pixel driving circuit 20 is connected, is not described here, and will be described in detail hereinafter; second scan signal ends S1-*n* of the pixel driving circuits 20 in the i-th row are connected to an output end of the first gate driving circuit in the (i−1)-th stage; third scan signal ends S2-*p* of the pixel driving circuits 20 in the i-th row are connected to an output end of the second gate driving unit in the i-th stage; fourth scan signal ends S2-*n* of the pixel driving circuits 20 in the i-th row are connected to an output end of the first gate driving unit in the i-th stage; and light-emitting control signal ends Emit of pixel driving circuits 20 in the i-th row are connected to an output end of the light-emitting control unit in the i-th stage, where i is an integer, and $1 \leq i \leq N$.

It should be understood that through the above-described arrangement, one first gate driving circuit may output both the second scan signal and the fourth scan signal, and compared with the fact that the second scan signal and the fourth scan signal are generated by two gate drive circuits respectively, the above-described arrangement may reduce the number of gate driving circuits, which is conductive to reducing the cost and increasing the screen-to-body ratio.

It should be noted that, for the convenience of drawing, the strobe circuit 10 is not shown in FIG. 13, but those skilled in the art will recognize that the strobe circuit 10 is actually present in the display panel shown in FIG. 13. The specific arrangement of the strobe circuit 10 has been described hereinbefore, which will not be repeated here.

In an embodiment, there are various specific implementation forms of the strobe signal. For example, the strobe signal may be directly provided by the driver IC 40, provided by a strobe signal generation circuit (arranged in the non-display area DA of the display panel), or provided by reusing other control signals in the pixel driver circuit 20. It should be understood that when the strobe signal is provided by reusing another control signal, the occupied pin resources of the driver IC 40 can be reduced and circuits used for generating certain control signals will be unnecessary, and therefore the design difficulty of the display panel can be reduced.

Regarding the exact signal to be reused as the strobe signal in the pixel driving circuit 20, a typical example will be described below, but it is not a limitation of the present application.

With continued reference to FIGS. 5 to 7 and FIG. 11, in an embodiment, the display panel includes multiple pixel driving circuits 20 and multiple strobe circuits 10, and each of the multiple strobe circuits 10 is electrically connected to a respective one of the multiple pixel driving circuits 20; or, the display panel includes multiple pixel driving circuits 20 and multiple strobe circuits 10, the multiple pixel driving circuits 20 are arranged in an array; the initialization signal end Vref of each row of pixel driving circuits 20 is electrically connected to a same strobe circuit 10; the strobe signal of the multiple strobe circuits 10 is reused as the second scan signal, the third scan signal, or the fourth scan signal of the multiple pixel driving circuits 20 electrically connected to the multiple strobe circuits.

Figure 14:
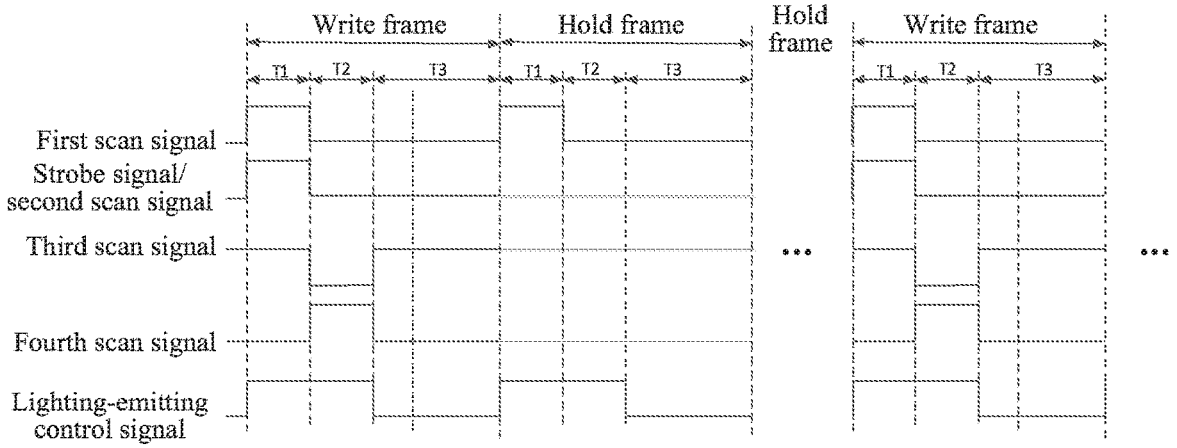
FIG. 14 is a driving timing diagram of a display panel provided by an embodiment of the present disclosure.

FIG. 14 is a driving timing diagram of a display panel provided by an embodiment of the present disclosure. Referring to FIG. 14, when the strobe signal is reused as a second scan signal, a time period corresponding to a valid pulse of a first scan signal is within a time period corresponding to a valid pulse of the second scan signal in a write frame, the time period corresponding to the valid pulse of the first scan signal coincides with the time period corresponding to the valid pulse of the second scan signal in the write frame (as shown in FIG. 14). Correspondingly, a driving method of the display panel is as follows: the write frame and the hold frame include an initialization phase T1, a data writing phase T2, and a light-emitting phase T3; in the initialization phase T1 of the write frame, a first strobe branch 110 of a strobe circuit 10 is turned on, a second strobe branch 120 is turned off, and the strobe circuit 10 outputs a first initialization voltage signal Vref1 to an initialization signal end Vref; in the data writing phase T2 of the write frame, the light-emitting phase T3 of the write frame and the whole hold frame, the second strobe branch 120 of the strobe circuit 10 is turned on, the first strobe branch 110 is turned off, and the strobe circuit 10 outputs a second initialization voltage signal Vref2 to the initialization signal end Vref.

With the driving timing shown in FIG. 14, a working process of the pixel driving circuit 20 is described below. In the initialization phase T1 of the write frame, a first initialization unit 210 and a second initialization unit 260 are turned on, and the first initialization unit 210 provides the first initialization voltage signal Vref1 to an anode of a light-emitting element 30, and the second initialization unit 260 provides the first initialization voltage signal Vref1 to a second node N2. In the data writing phase T2 of the write frame, a data writing unit 240 and a threshold compensation unit 250 are both turned on, and a data voltage signal of a data signal end Vdata is written into the second node N2 sequentially through the data writing unit 240, the driving transistor 230 and the threshold compensation unit 250, so that the voltage at a gate electrode (namely a control end of the driving transistor 230) of the driving transistor 230 is gradually increased, the driving transistor 230 is turned off until a voltage difference between the gate voltage of the driving transistor 230 and a voltage of a first electrode of the driving transistor 230 is equal to a threshold voltage of the driving transistor 230. In the light-emitting phase T3 of the write frame, a first light-emitting control unit 220 and a second light-emitting control unit 270 are turned on, a driving current generated by the driving transistor 230 flows into the light-emitting element 30, and the light-emitting element 30 emits light in response to the driving current. In the initialization phase T1 of the hold frame, the first initialization unit 210 is turned on, and the first initialization unit 210 provides the second initialization voltage signal Vref2 to the anode of the light-emitting element 30. In the data writing phase T2 of the hold frame, there is no action. In the light-emitting phase T3 of the hold frame, the first light-emitting control unit 220 and the second light-emitting control unit 270 are turned on, the driving current generated by the driving transistor 230 flows into the light-emitting element 30, and the light-emitting element 30 emits light in response to the driving current.

Figure 15:
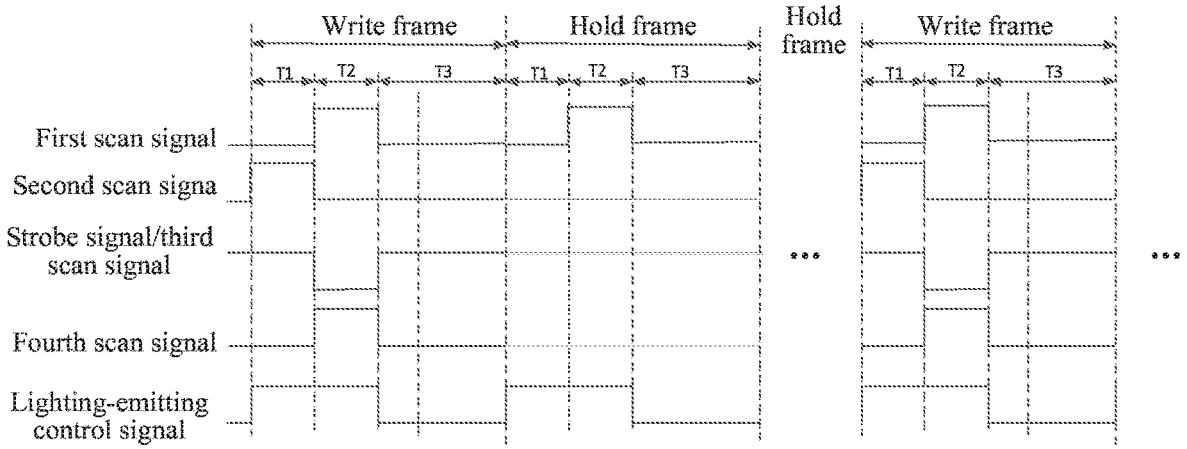
FIG. 15 is a driving timing diagram of another display panel provided by an embodiment of the present disclosure.

FIG. 15 is a driving timing diagram of another display panel provided by an embodiment of the present disclosure.

Referring to FIG. 15, when the strobe signal is reused as a third scan signal, a time period corresponding to a valid pulse of a first scan signal is within a time period corresponding to a valid pulse of the third scan signal in a write frame, the time period corresponding to the valid pulse of the first scan signal coincides with the time period corresponding to the valid pulse of the third scan signal in the write frame (as shown in FIG. 15). Correspondingly, a driving method of the display panel is as follows: the write frame and the hold frame each include an initialization phase T1, a data writing phase T2, and a light-emitting phase T3; in the data writing phase T2 of the write frame, a first strobe branch 110 of the strobe circuit 10 is turned on, a second strobe branch 120 is turned off, and the strobe circuit 10 outputs a first initialization voltage signal Vref1 to an initialization signal end Vref; in the initialization phase T1 of the write frame, the light-emitting phase T3 of the write frame and the whole hold frame, the second strobe branch 120 of the strobe circuit 10 is turned on, the first strobe branch 110 is turned off, and the strobe circuit 10 outputs a second initialization voltage signal Vref2 to the initialization signal end Vref.

Figure 16:
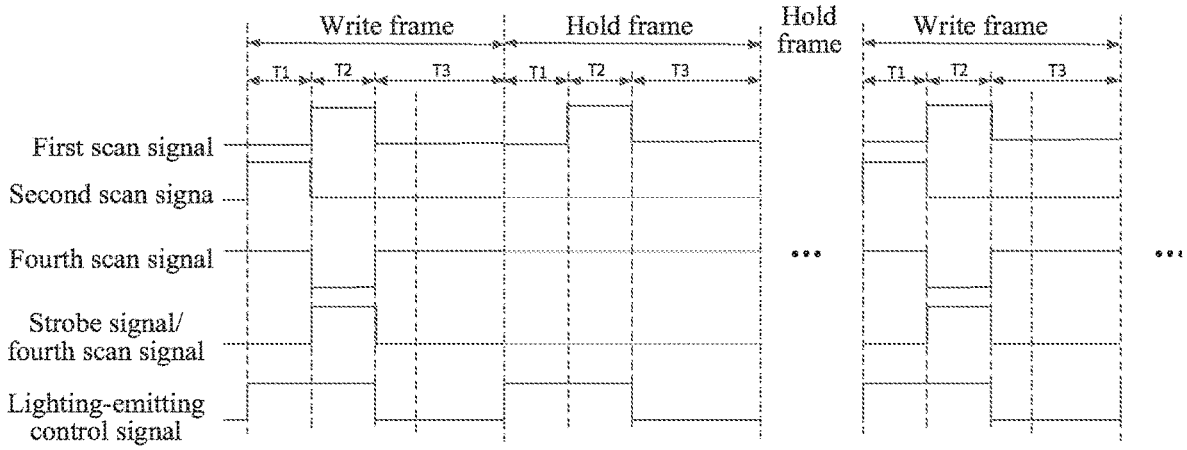
FIG. 16 is a driving timing diagram of still another display panel provided by an embodiment of the present disclosure.

FIG. 16 is a driving timing diagram of still another display panel provided by an embodiment of the present disclosure. Referring to FIG. 16, when the strobe signal is reused as a fourth scan signal, a time period corresponding to a valid pulse of a first scan signal is within a time period corresponding to a valid pulse of the fourth scan signal in the write frame, the time period corresponding to the valid pulse of the first scan signal of the write frame coincides with the time period corresponding to the valid pulse of the fourth scan signal in the write frame (as shown in FIG. 16). Correspondingly, a driving method of the display panel is as follows: the write frame and the hold frame each include an initialization phase T1, a data writing phase T2, and a light-emitting phase T3; in the data writing phase T2 of the write frame, a first strobe branch 110 of the strobe circuit 10 is turned on, a second strobe branch 120 is turned off, and the strobe circuit 10 outputs a first initialization voltage signal Vref1 to an initialization signal end Vref; in the initialization phase T1 of the write frame, the light-emitting phase T3 of the write frame, and the hold frame, the second strobe branch 120 of the strobe circuit 10 is turned on, the first strobe branch 110 is turned off, and the strobe circuit 10 outputs a second initialization voltage signal Vref2 to the initialization signal end Vref.

With the driving timings shown in FIGS. 15 and 16, a working process of the pixel driving circuit 20 is described below. In the initialization phase T1 of the write frame, a second initialization unit 260 is turned on, and the second initialization unit 260 provides the first initialization voltage signal Vref1 to a second node N2. In the data writing phase T2 of the write frame, a first initialization unit 210 is turned on, the first initialization unit 210 provides the first initialization voltage signal Vref1 to an anode of a light-emitting element 30, and meanwhile, a data writing unit 240 and a threshold compensation unit 250 are both turned on, a data voltage signal of a data signal end Vdata is written into the second node N2 sequentially through the data writing unit 240, the driving transistor 230, and the threshold compensation unit 250, so that the voltage at a gate electrode (namely a control end of the driving transistor 230) of the driving transistor 230 is gradually increased, the driving transistor 230 is turned off until a voltage difference between the gate voltage of the driving transistor 230T and a voltage of a first electrode of the driving transistor 230 is equal to a threshold voltage of the driving transistor 230. In the light-emitting phase T3 of the write frame, a first light-emitting control unit 220 and a second light-emitting control unit 270 are turned on, a driving current generated by the driving transistor 230 flows into the light-emitting element 30, and the light-emitting element 30 emits light in response to the driving current. In the initialization phase T1 of the hold frame, there is no action. In the data writing phase T2 of the hold frame, the first initialization unit 210 is turned on, and the first initialization unit 210 provides the second initialization voltage signal Vref2 to the anode of the light-emitting element 30. In the light-emitting phase T3 of the hold frame, the first light-emitting control unit 220 and the second light-emitting control unit 270 are turned on, a driving current generated by the driving transistor 230 flows into the light-emitting element 30, and the light-emitting element 30 emits light in response to the driving current.

It should be noted that the timing sequences exemplarily shown in FIGS. 14 and 16 correspond to a situation that a fourth transistor M4, a fifth transistor M5, an eighth transistor M8 and the driving transistor 230 are P-type transistors, and a third transistor M3, a sixth transistor M6 and a seventh transistor M7 are N-type transistors; and meanwhile, a first transistor M1 is an N-type transistor, and a second transistor M2 is a P-type transistor, or both the first transistor M1 and the second transistor M2 are N-type transistors. The timing sequence exemplarily shown in FIG. 15 corresponds to a situation that the fourth transistor M4, the fifth transistor M5, the eighth transistor M8, and the driving transistor 230 are P-type transistors, and the third transistor M3, the sixth transistor M6 and the seventh transistor M7 are N-type transistors; and meanwhile, the first transistor M1 is a P-type transistor, the second transistor M2 is an N-type transistor, or both the first transistor M1 and the second transistor M2 are P-type transistors, but it is not a limitation of the present application. Generally, the P-type transistor is turned on under the control of a low-level signal and is turned off under the control of a high-level signal; the N-type transistor is turned on under the control of the high-level signal, and is turned off under the control of the low-level signal. In some optional embodiments, the transistors in the pixel driving circuit 20 may all be N-type transistors, or all be P-type transistors, or part of the N-type transistors and part of the P-type transistors. The types of the transistors in the pixel driving circuit 20 and the strobe circuit 10 are not specifically limited in the embodiments of the present disclosure.

Specifically, there are various specific implementation forms of the first scan signal. For example, the first scan signal may be directly provided by the driver IC 40, provided by a first scan signal generation circuit (arranged in the non-display area DA of the display panel), or provided by reusing other control signals in the pixel driving circuit 20. It should be understood that when the first scan signal is provided by reusing another control signal, the occupied pin resources of the driver IC 40 can be reduced and circuits used for generating certain control signals will be unnecessary, and therefore the design difficulty of the display panel can be reduced.

Regarding the exact signal to be reused as the first scan signal in the pixel driving circuit 20, and a typical example will be described below, but it is not a limitation of the present application.

Figure 17:
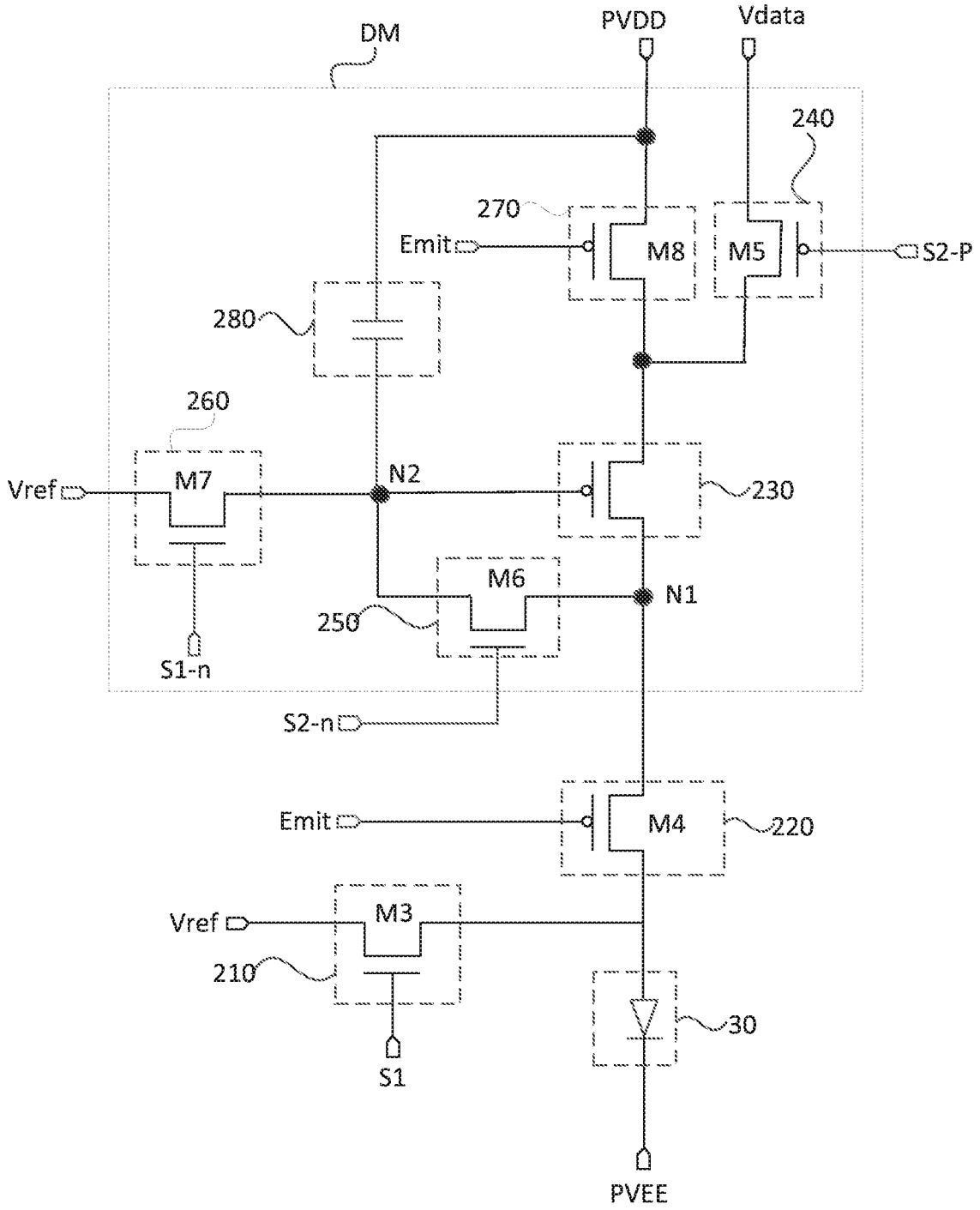
FIG. 17 is a diagram of a circuit element of another pixel driving circuit provided by an embodiment of the present disclosure.
Figure 18:
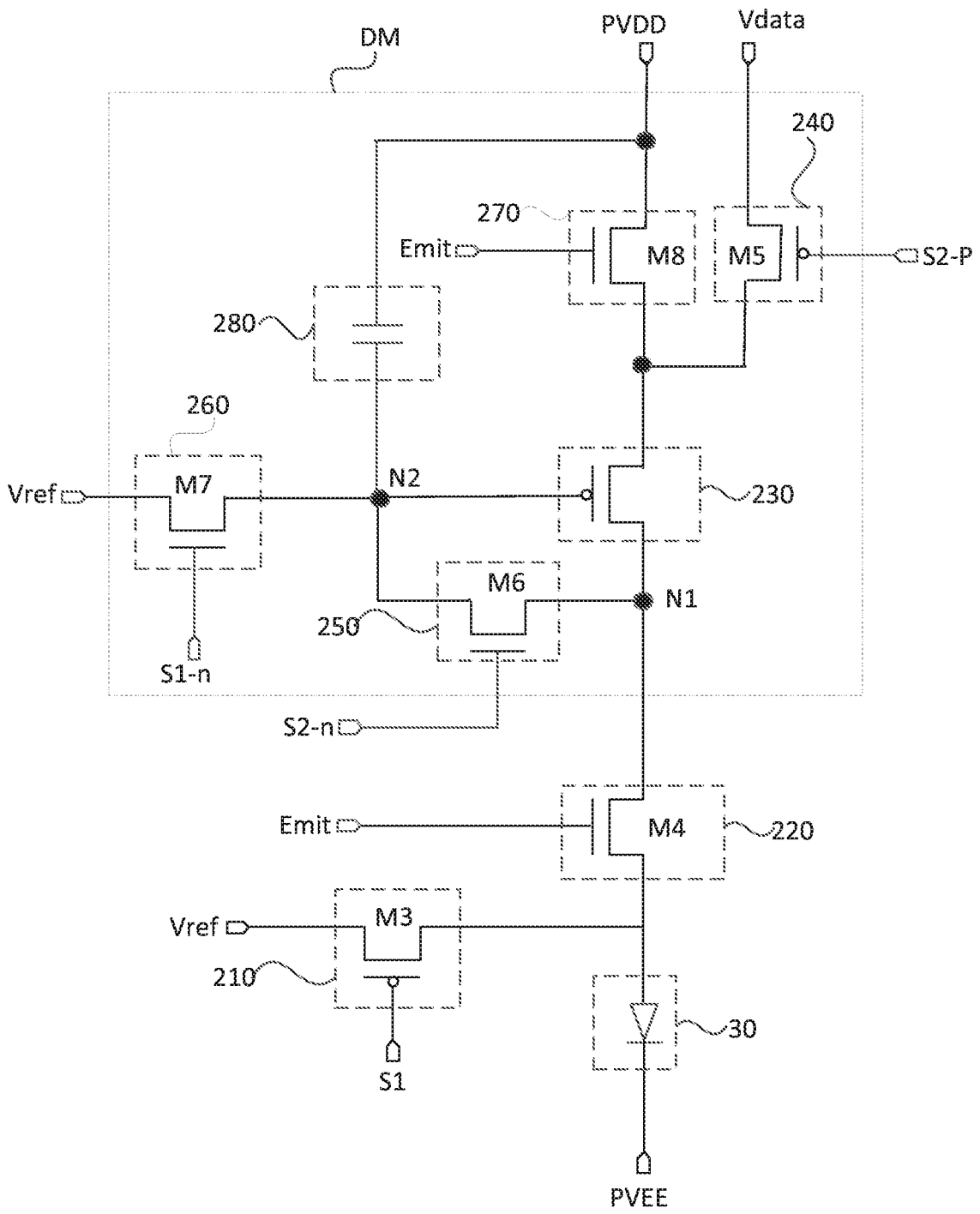
FIG. 18 is a diagram of a circuit element of still another pixel driving circuit provided by an embodiment of the present disclosure.

FIG. 17 is a diagram of a circuit element of another pixel driving circuit provided by an embodiment of the present disclosure. FIG. 18 is a diagram of a circuit element of still another pixel driving circuit provided by an embodiment of the present disclosure. Referring to FIG. 18, in an embodiment, a transistor in a first initialization unit 210 is an N-type transistor, and a transistor in a first light-emitting control unit 220 is a P-type transistor (as shown in FIG. 17); or, the transistor in the first initialization unit 210 is the P-type transistor, and the transistor in the first light-emitting control unit 220 is the N-type transistor (as shown in FIG. 18); and a light-emitting control signal is reused as a first scan signal.

In an embodiment, referring to FIG. 17, a third transistor M3 is an N-type transistor, a fourth transistor M4 is a P-type transistor, and meanwhile, an eighth transistor M8 is a P-type transistor; or, referring to FIG. 18, the third transistor M3 is a P-type transistor, the fourth transistor M4 is an N-type transistor, while the eighth transistor M8 is an N-type transistor.

Figure 19:
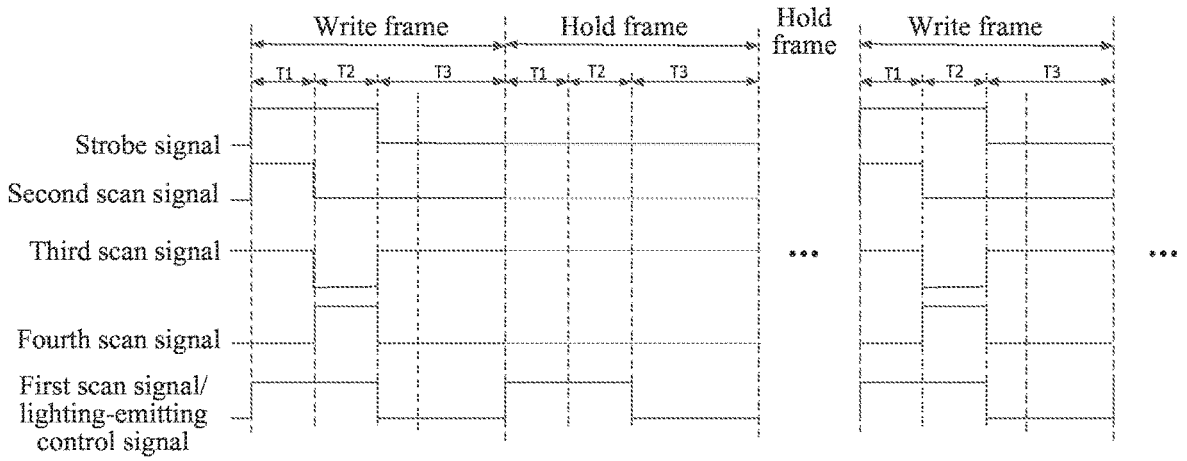
FIG. 19 is a driving timing diagram of yet another display panel provided by an embodiment of the present disclosure.
Figure 20:
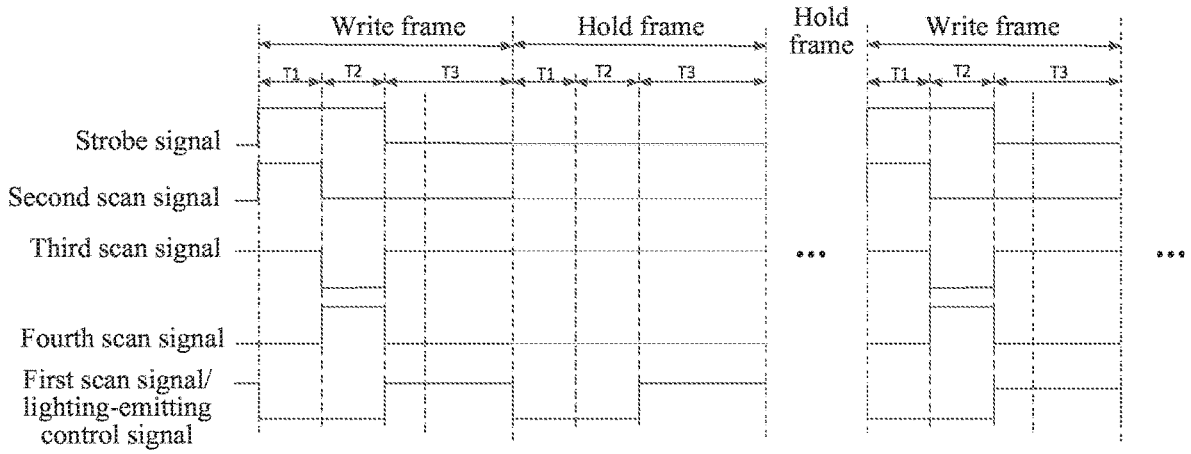
FIG. 20 is a driving timing diagram of a display panel provided by an embodiment of the present disclosure.

FIG. 19 is a driving timing diagram of yet another display panel provided by an embodiment of the present disclosure. FIG. 20 is a driving timing diagram of a display panel provided by an embodiment of the present disclosure. A driving timing sequence shown in FIG. 19 corresponds to the display panel including the pixel driving circuit 20 shown in FIG. 17, and a driving timing sequence shown in FIG. 20 corresponds to the display panel including the pixel driving circuit 20 shown in FIG. 18. Referring to FIGS. 19 and 20, a time period corresponding to an invalid pulse of a light-emitting control signal is within a time period corresponding to a valid pulse of a strobe signal, and the time period corresponding to the valid pulse of the strobe signal does not exceed a time period corresponding to a whole write frame. In an embodiment, the time period corresponding to the invalid pulse of the lighting control signal coincides with the time period corresponding to the valid pulse of the strobe signal, as shown in FIGS. 19 and 20.

With the driving timing sequences shown in FIGS. 19 and 20, a working process of the pixel driving circuit 20 is described below. In an initialization phase T1 of the write frame, a first initialization unit 210 and a second initialization unit 260 are turned on, and the first initialization unit 210 provides a first initialization voltage signal Vref1 to an anode of a light-emitting element 30, and the second initialization unit 260 provides the first initialization voltage signal Vref1 to a second node N2. In a data writing phase T2 of the write frame, the first initialization unit 210 is turned on, the first initialization unit 210 provides the first initialization voltage signal Vref1 to the anode of the light-emitting element 30, and meanwhile, a data writing unit 240 and a threshold compensation unit 250 are both turned on, and a data voltage signal of a data signal end Vdata is written into the second node N2 sequentially through the data writing unit 240, the driving transistor 230 and the threshold compensation unit 250 (the specific processes are as described in the above). In a light-emitting phase T3 of the write frame, a first light-emitting control unit 220 and a second light-emitting control unit 270 are turned on, a driving current generated by the driving transistor 230 flows into the light-emitting element 30, and the light-emitting element 30 emits light in response to the driving current. In the initialization phase T1 and the data writing phase T2 of the hold frame, the first initialization unit 210 is turned on, and the first initialization unit 210 provides a second initialization voltage signal Vref2 to the anode of the light-emitting element 30. In the light-emitting phase T3 of the hold frame, the first light-emitting control unit 220 and the second light-emitting control unit 270 are turned on, a driving current generated by the driving transistor 230 flows into the light-emitting element 30, and the light-emitting element 30 emits light in response to the driving current.

It should be noted that the timing sequences exemplarily shown in FIGS. 19 and 20 correspond to a situation that a fifth transistor M5 and the driving transistor 230 are P-type transistors, and a sixth transistor M6 and a seventh transistor M7 are N-type transistors; and meanwhile, a first transistor M1 is an N-type transistor, a second transistor M2 is a P-type transistor, or both the first transistor M1 and the second transistor M2 are P-type transistors, but it is not a limitation of the present application. The types of the fifth transistor M5, the driving transistor 230, the sixth transistor M6, the seventh transistor M7 in the pixel driving circuit 20 and the transistors in the strobe circuit 10 are not specifically limited in the embodiments of the present disclosure.

With continued reference to FIG. 12, in an embodiment, a transistor in the data writing unit 240 and a transistor in the first initialization unit 210 are of a same type; a first scan signal is reused as a third scan signal.

Specifically, the fifth transistor M5 and the third transistor M3 are of a same type, and may both be P-type transistors (as shown in FIG. 12), or both be N-type transistors, which is not limited here.

Figure 21:
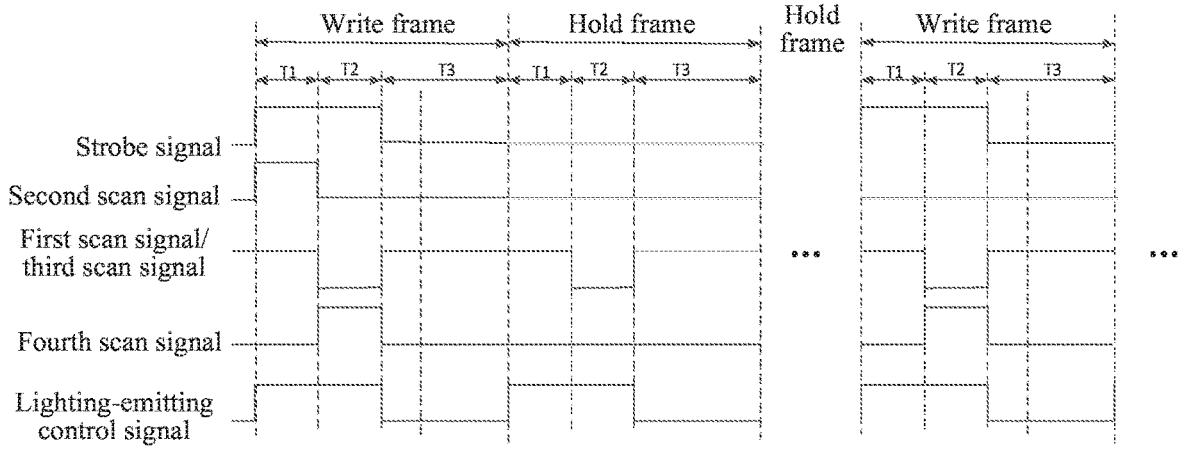
FIG. 21 is a driving timing diagram of another display panel provided by an embodiment of the present disclosure.
Figure 22:
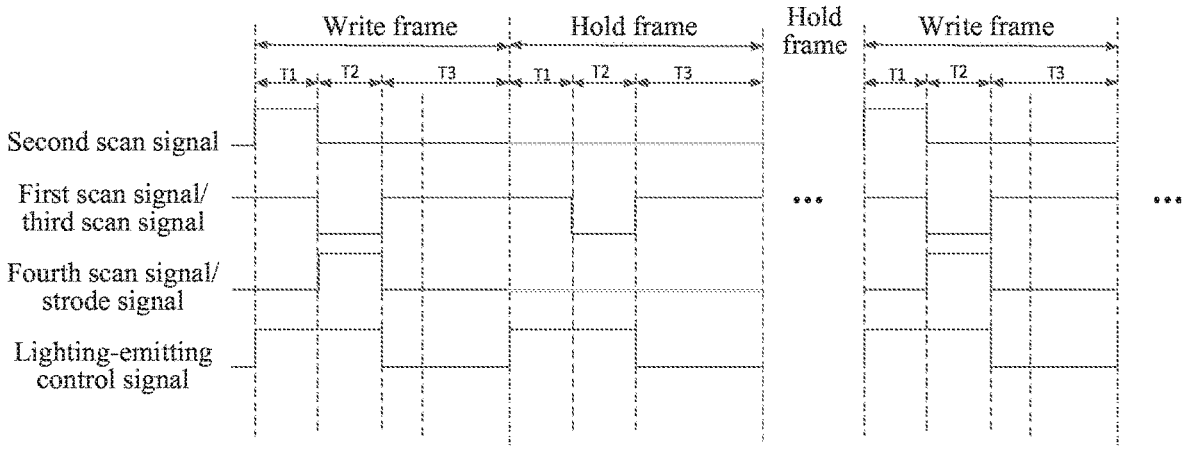
FIG. 22 is a driving timing diagram of still another display panel provided by an embodiment of the present disclosure.

FIG. 21 is a driving timing diagram of another display panel provided by an embodiment of the present disclosure. FIG. 22 is a driving timing diagram of still another display panel provided by an embodiment of the present disclosure. Referring to FIGS. 21-22, a time period corresponding to a valid pulse of a third scan signal is within a time period corresponding to a valid pulse of a strobe signal, and the time period corresponding to the valid pulse of the strobe signal does not exceed a time period corresponding to a whole write frame. In an embodiment, the strobe signal is reused as the third scan signal, as shown in FIG. 22.

With the driving timing sequences shown in FIGS. 21 and 22, a working process of the pixel driving circuit 20 is described below. In an initialization phase T1 of the write frame, a second initialization unit 260 is turned on, and the second initialization unit 260 provides a first initialization voltage signal Vref1 to a second node N2. In a data writing phase T2 of the write frame, the first initialization unit 210 is turned on, the first initialization unit 210 provides the first initialization voltage signal Vref1 to an anode of a light-emitting element 30, and meanwhile, a data writing unit 240 and the threshold compensation unit 250 are both turned on, and a data voltage signal of a data signal end Vdata is written into the second node N2 sequentially through the data writing unit 240, the driving transistor 230 and the threshold compensation unit 250. In a light-emitting phase T3 of the write frame, a first light-emitting control unit 220 and a second light-emitting control unit 270 are turned on, the driving current generated by the driving transistor 230 flows into the light-emitting element 30, and the light-emitting element 30 emits light in response to the driving current. In the initialization phase T1 of the hold frame, there is no action. In the data writing phase T2 of the hold frame, the first initialization unit 210 and the data writing unit 240 are turned on, the first initialization unit 210 provides a second initialization voltage signal Vref2 to the anode of the light-emitting element 30, and the data writing unit 240 is connected between a data voltage signal end in a floating state and a first electrode of the driving transistor 230. In the light-emitting phase T3 of the hold frame, the first light-emitting control unit 220 and the second light-emitting control unit 270 are turned on, a driving current generated by the driving transistor 230 flows into the light-emitting element 30, and the light-emitting element 30 emits light in response to the driving current.

In an embodiment, in the hold frame, the data writing unit 240 is configured to transfer a fixed voltage signal provided by the data signal end Vdata to the first electrode of the driving transistor 230 under the control of the third scan signal; a voltage value of the fixed voltage signal is equal to a voltage value of a first power supply voltage signal.

It should be understood that at the end of the data writing phase T2 of the write frame, a voltage of the first electrode of the driving transistor 230 is a voltage value corresponding to the data voltage signal, which is referred to as vdata, and then at an initial moment of the light-emitting phase T3, the voltage of the first electrode of the driving transistor 230 is changed from the determined voltage value vdata into a voltage value of a first power supply signal end PVDD, which is referred to as pvdd. When a first scan signal is reused as the third scan signal, the data writing unit 240 will also be turned on in the data writing phase T2 of the hold frame, and the fixed voltage signal is provided at the data signal end Vdata, so that the voltage value of the first electrode of the driving transistor 230 at the end of the data writing phase T2 is a determined value, such as pvdd, or it may be a voltage value corresponding to a data voltage signal written into by a write frame closest to the hold frame in the time may be obtained. In this way, no matter in the write frame or in the hold frame, a voltage value of the driving transistor 230 is changed from a fixed potential into the pvdd at the initial moment of the light-emitting phase T3, the floating of the first electrode of the driving transistor 230 is avoided, the potential instability of the first electrode of the driving transistor 230 in the light-emitting phase T3 is avoided, i.e. it is controllable, and thus the risk of display instability is reduced.

Figure 23:
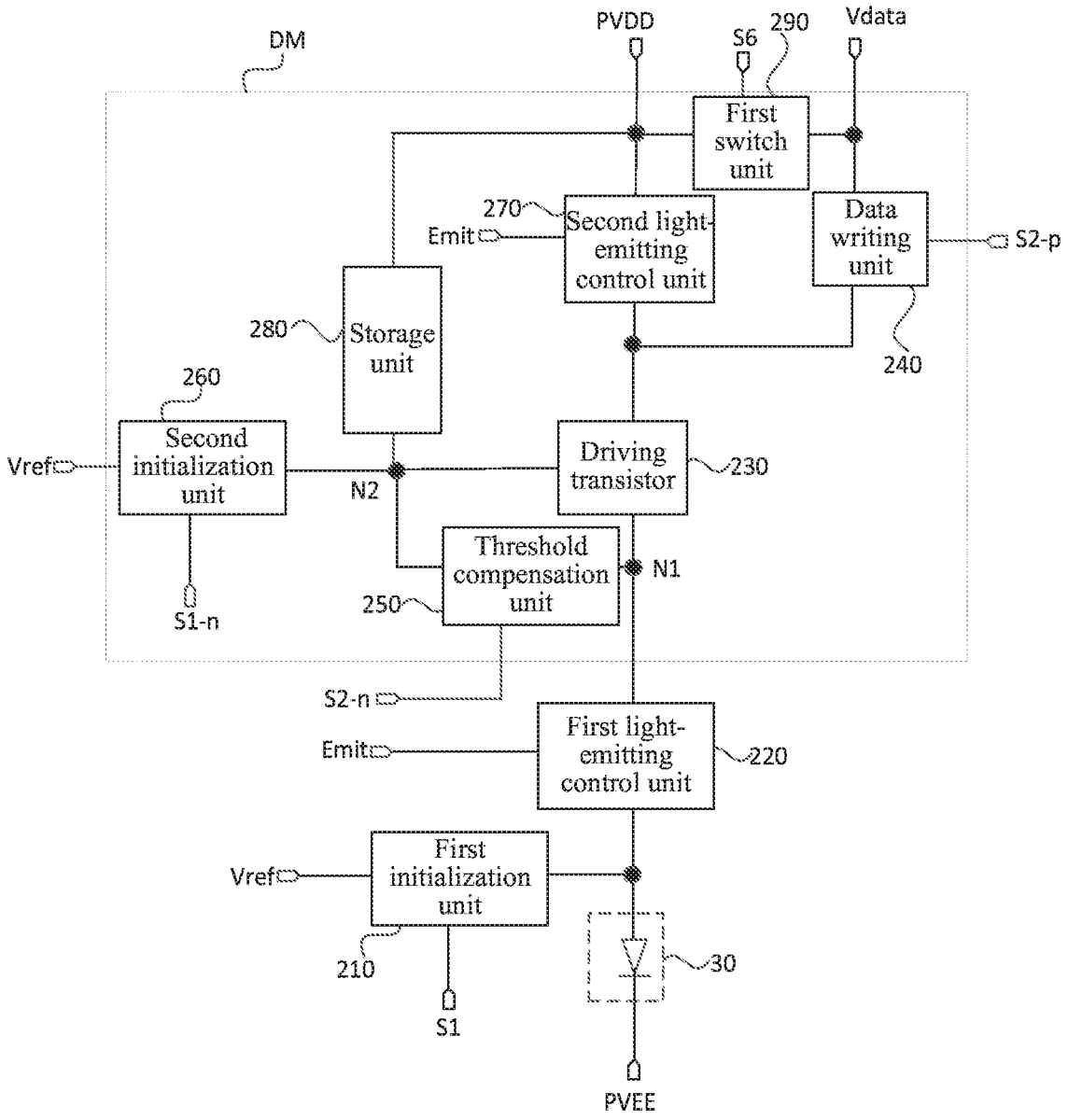
FIG. 23 is a block diagram of still another pixel driving circuit provided by an embodiment of the present disclosure.
Figure 24:
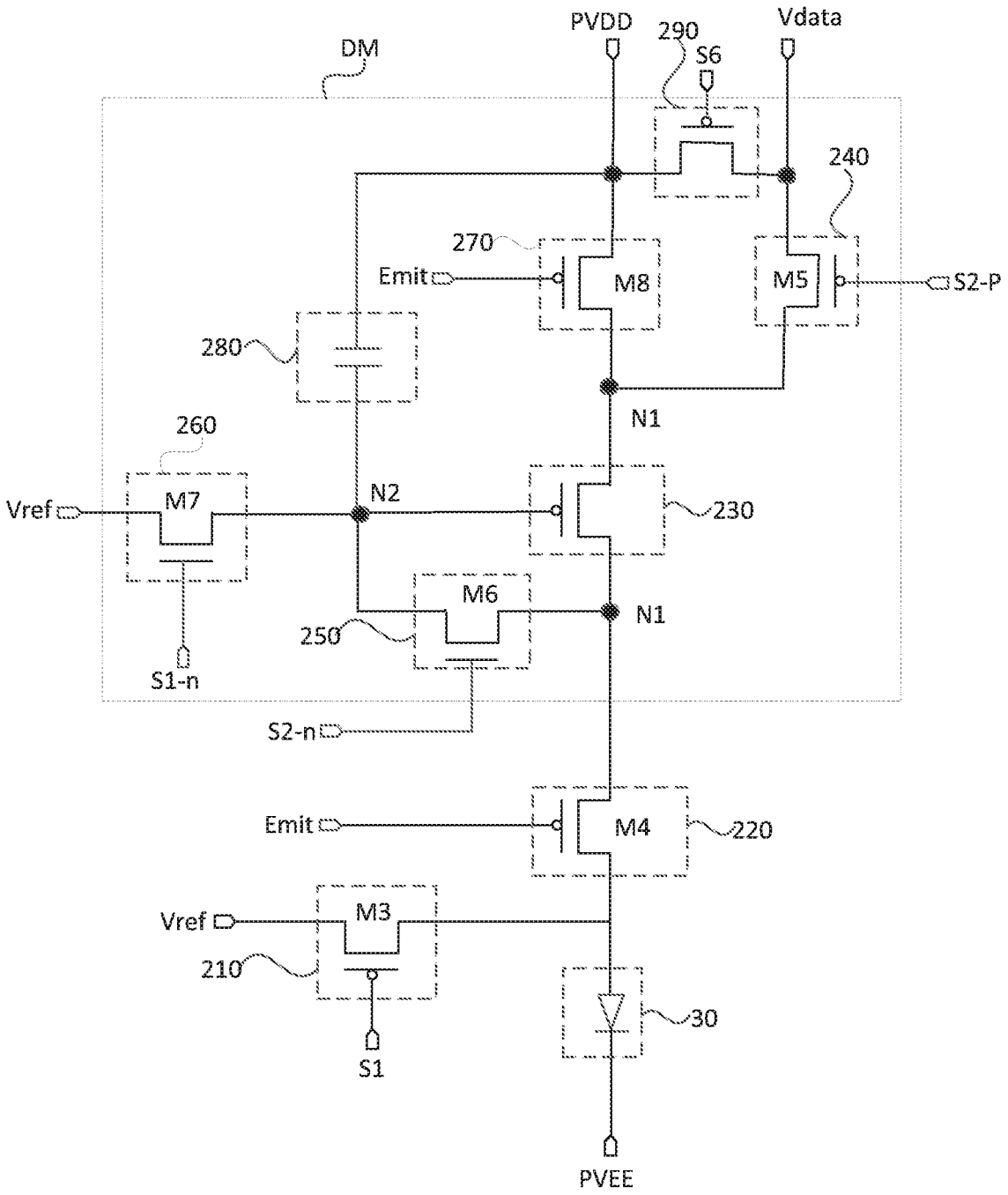
FIG. 24 is a diagram of a circuit element of yet another pixel driving circuit provided by an embodiment of the present disclosure.

FIG. 23 is a block diagram of still another pixel driving circuit provided by an embodiment of the present disclosure. FIG. 24 is a diagram of a circuit element of yet another pixel driving circuit provided by an embodiment of the present disclosure. Referring to FIGS. 23 and 24, in an embodiment, the pixel driving circuit 20 further includes a first switch unit 290 electrically connected between a data writing unit 240 and a first power supply signal end PVDD. In a hold frame, the first switch unit 290 is configured to transfer a first power supply voltage signal to a data writing unit 240, enabling the data writing unit 240 to provide a first power supply voltage signal to a first electrode of a driving transistor 230 under the control of a third scan signal.

In an embodiment, the pixel driving circuit 20 further includes a sixth scan signal end S6 for receiving a sixth scan signal, and a control end of the first switch unit 290 is connected to the sixth scan signal end S6. In a write frame, the first switch unit 290 is configured to be turned off under the control of the sixth scan signal, and in the hold frame, the first switch unit 290 is configured to be turned on at least in a data writing phase T2 under the control of the sixth scan signal, so that a first power supply voltage signal is written into the first electrode of the driving transistor 230 sequentially through the first switch unit 290 and the data writing stage T2. Specifically, the first switch unit 290 includes a ninth transistor M9, a first electrode of the ninth transistor M9 is electrically connected to the first power supply signal end PVDD, and a second electrode of the ninth transistor M9 is electrically connected to the data signal end Vdata, and a control end of the ninth transistor M9 is electrically connected to the sixth scan signal end S6.

Figure 25:
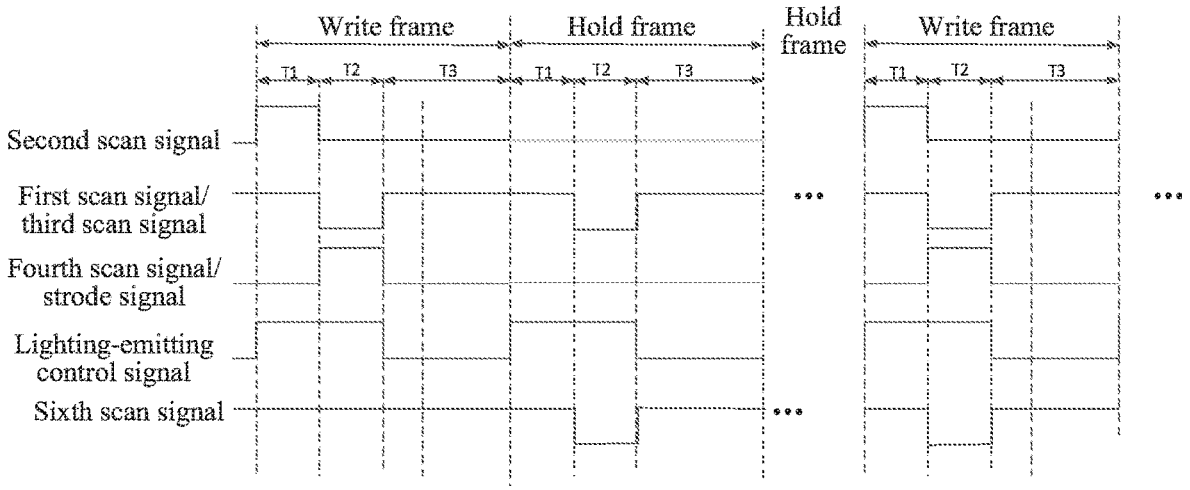
FIG. 25 is a driving timing diagram of yet another display panel provided by an embodiment of the present disclosure.

FIG. 25 is a driving timing diagram of yet another display panel provided by an embodiment of the present disclosure. With the driving timing sequence shown in FIG. 25, a working process of the pixel driving circuit 20 is described below. In an initialization phase T1 of a write frame, a second initialization unit 260 is turned on, and the second initialization unit 260 provides a first initialization voltage signal Vref1 to a second node N2. In a data writing phase T2 of the write frame, a first initialization unit 210 is turned on, the first initialization unit 210 provides the first initialization voltage signal Vref1 to an anode of a light-emitting element 30, and meanwhile, a data writing unit 240 and a threshold compensation unit 250 are both turned on, a data voltage signal of a data signal end Vdata is written into the second node N2 sequentially through the data writing unit 240, the driving transistor 230 and the threshold compensation unit 250. In a light-emitting phase T3 of the write frame, a first light-emitting control unit 220 and a second light-emitting control unit 270 are turned on, a driving current generated by the driving transistor 230 flows into the light-emitting element 30, and the light-emitting element 30 emits light in response to the driving current. In the initialization phase T1 of a hold frame, there is no action. In the data writing phase T2 of the hold frame, the first initialization unit 210 is turned on, the first initialization unit 210 provides a second initialization voltage signal Vref2 to the anode of the light-emitting element 30, and meanwhile, the data writing unit 240 and the first switch unit 290 are turned on, the first power supply voltage signal is written into a first electrode of the driving transistor 230 sequentially through the data writing unit 240 and the first switch unit 290 in sequence. In a light-emitting phase T3 of the hold frame, the first light-emitting control unit 220 and the second light-emitting control unit 270 are turned on, a driving current generated by the driving transistor 230 flows into the light-emitting element 30, and the light-emitting element 30 emits light in response to the driving current.

It should be noted that the timing sequences exemplarily shown in FIGS. 21, 22 and 25 correspond to a situation that a third transistor M3, a fourth transistor M4, a fifth transistor M5, an eighth transistor M8, a ninth transistor M9, and the driving transistor 230 are P-type transistors, and a sixth transistor M6 and a seventh transistor M7 are N-type transistors; and meanwhile, a first transistor M1 is an N-type transistor, a second transistor M2 is a P-type transistor, or both the first transistor M1 and the second transistor M2 are N-type transistors, but it is not a limitation of the present application. The types of the transistors in the pixel driving circuit 20 and the strobe circuit 10 are not specifically limited in the embodiments of the present disclosure.

Figure 26:
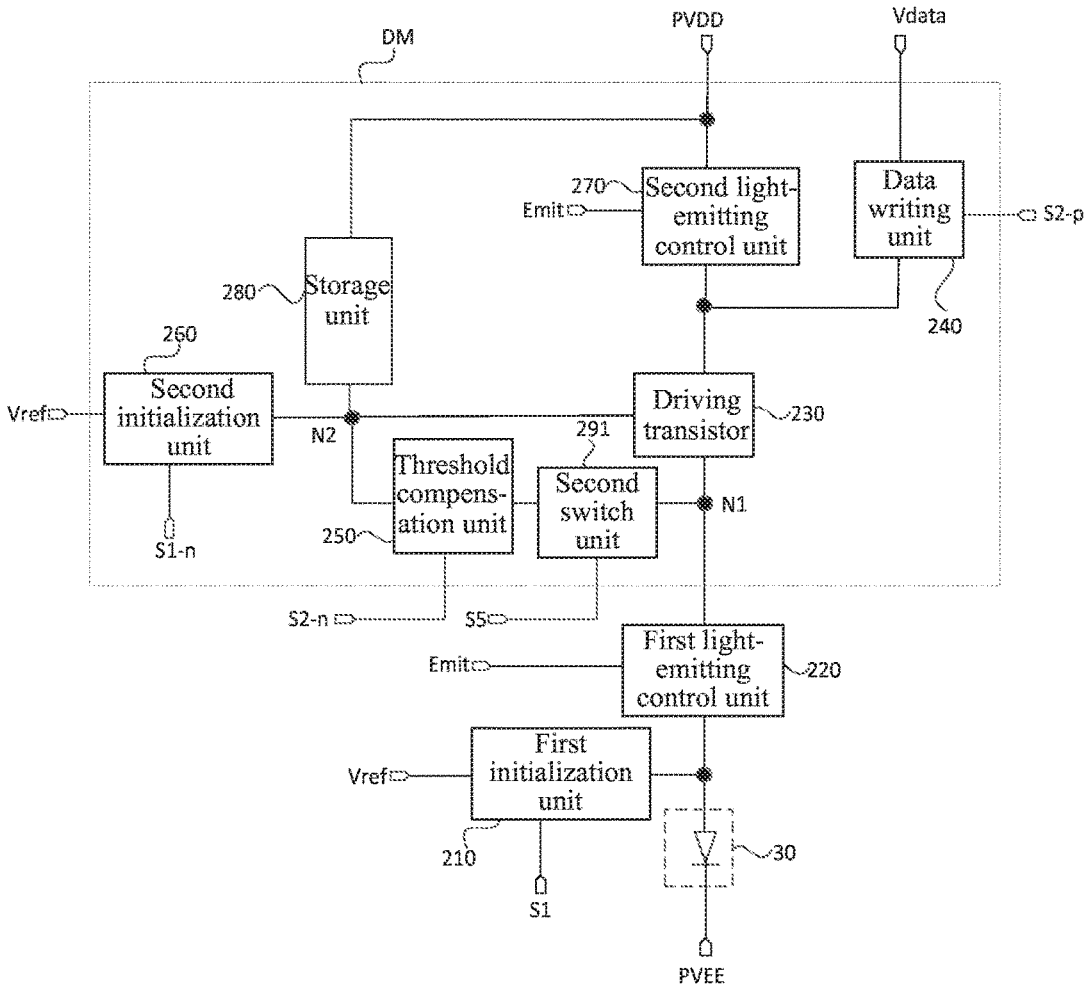
FIG. 26 is a block diagram of yet another pixel driving circuit provided by an embodiment of the present disclosure.
Figure 27:
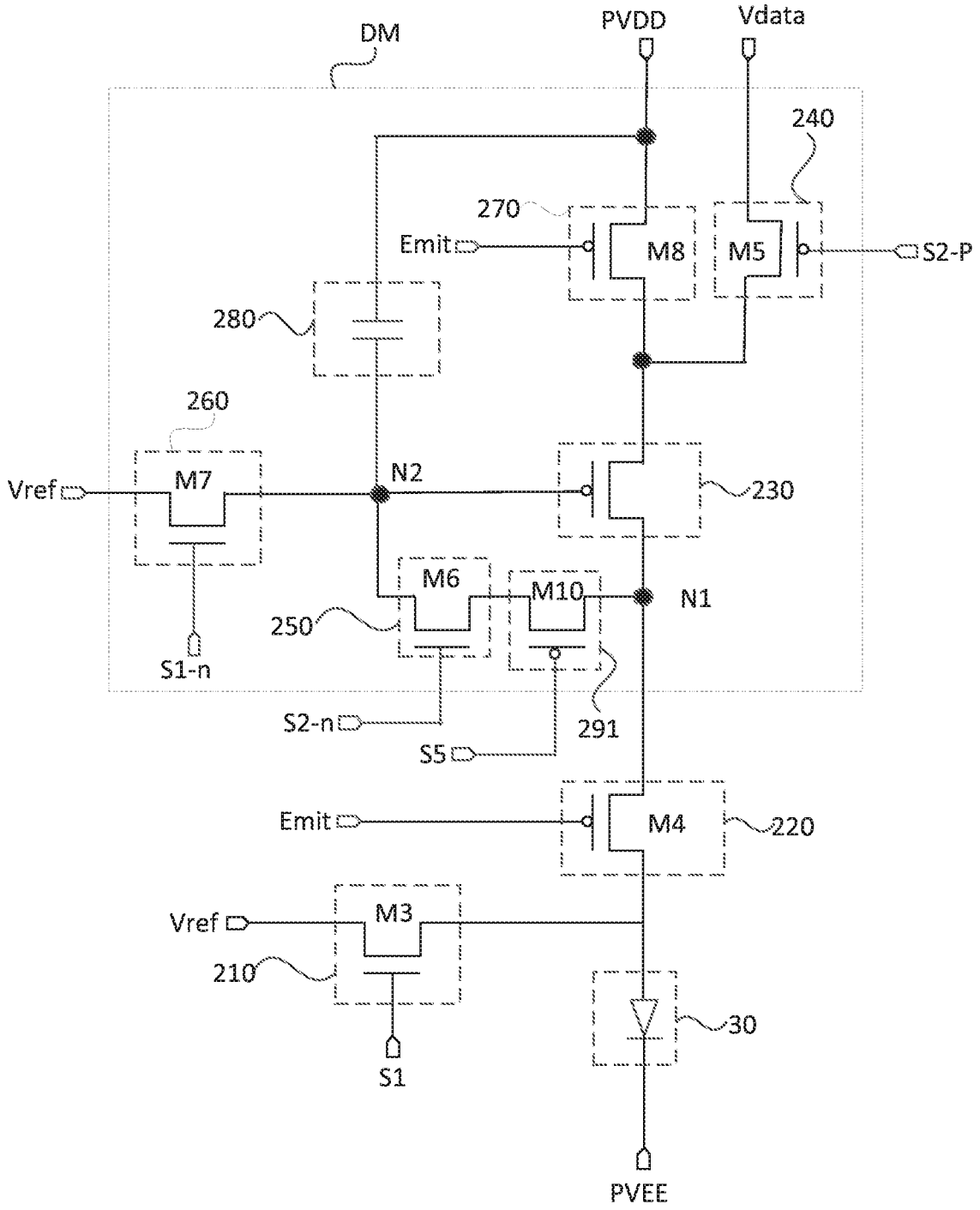
FIG. 27 is a diagram of a circuit element of a pixel driving circuit provided by an embodiment of the present disclosure.
Figure 28:
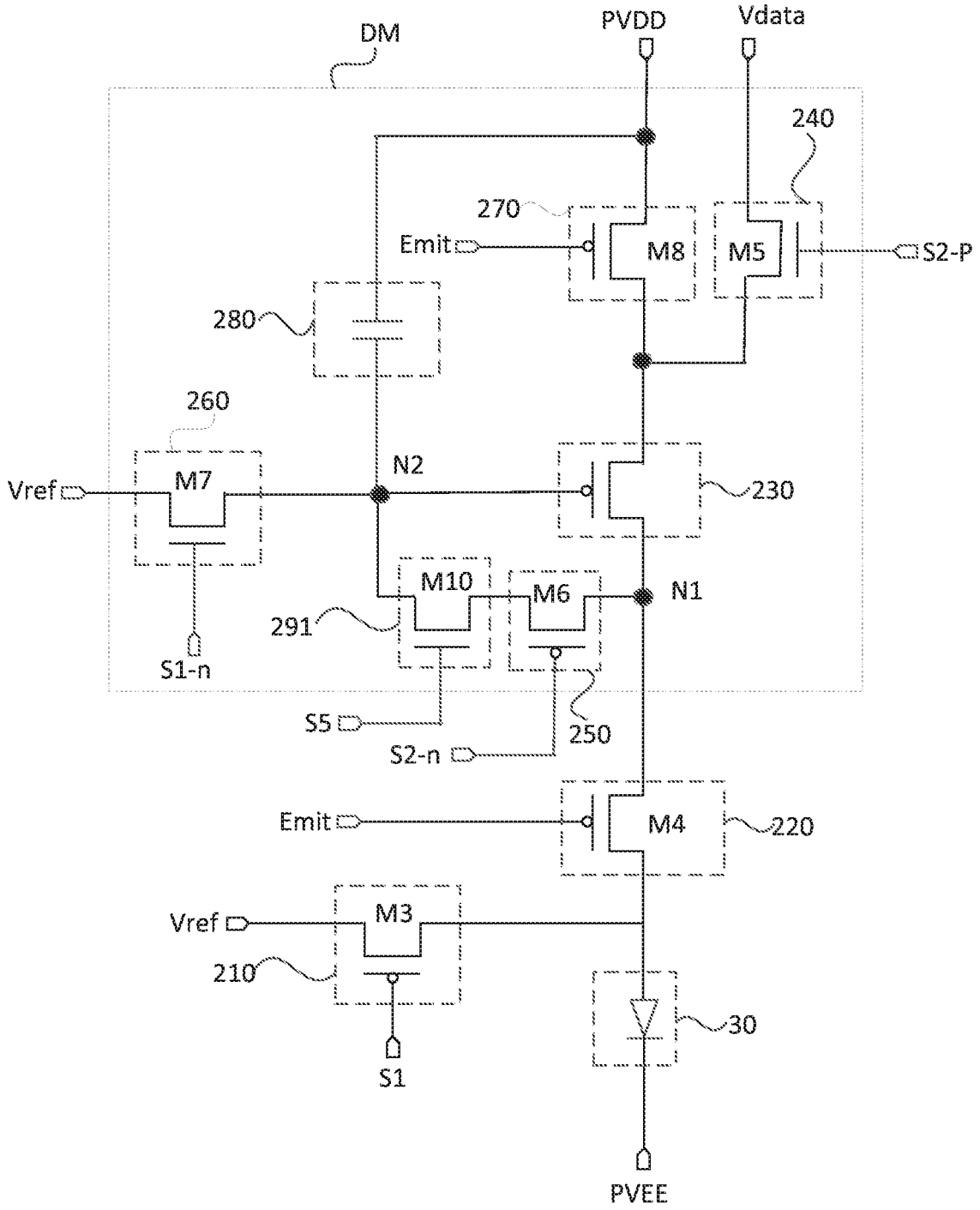
FIG. 28 is a diagram of a circuit element of another pixel driving circuit provided by an embodiment of the present disclosure.
Figure 29:
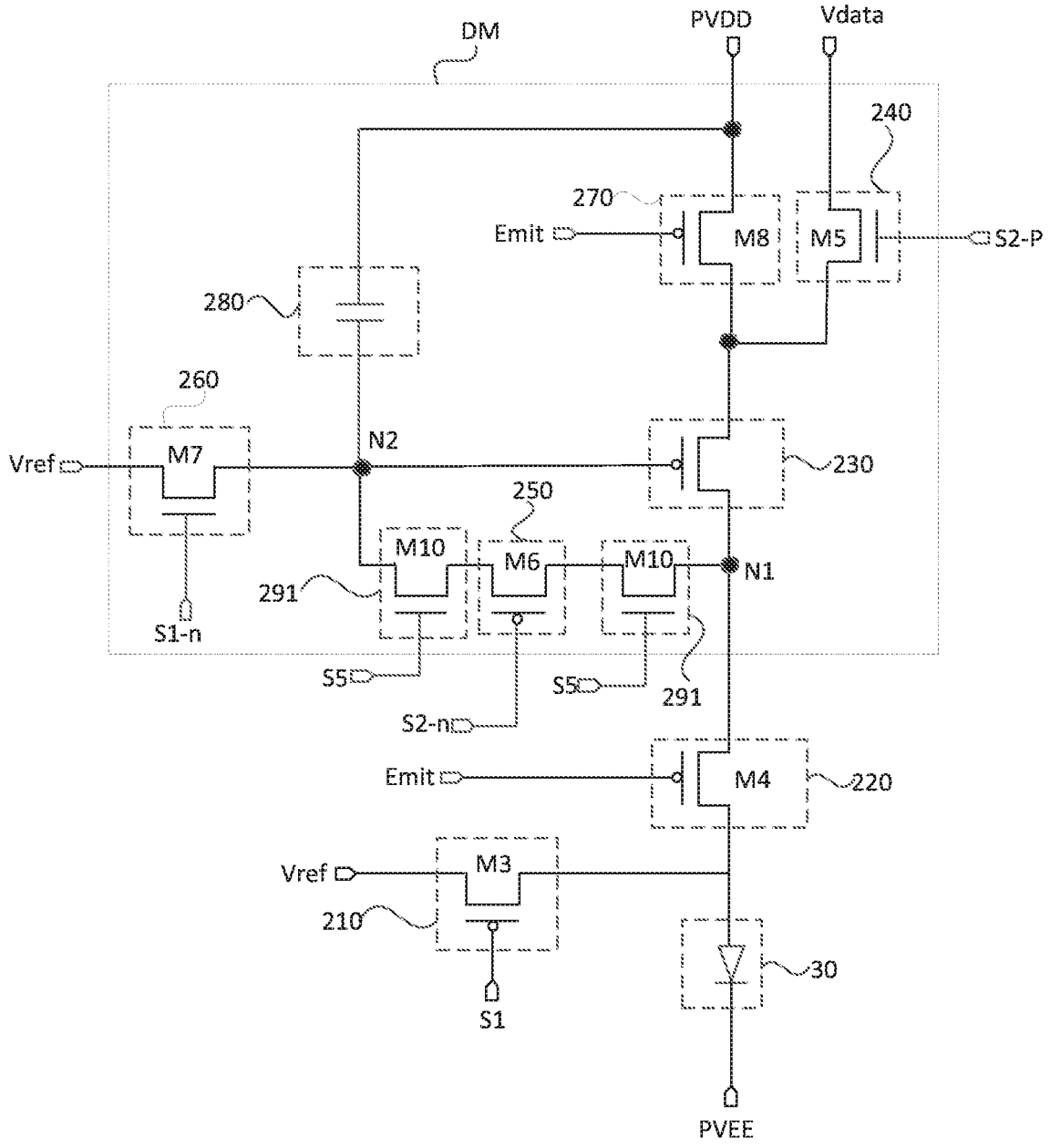
FIG. 29 is a diagram of a circuit element of still another pixel driving circuit provided by an embodiment of the present disclosure.

FIG. 26 is a block diagram of yet another pixel driving circuit provided by an embodiment of the present disclosure. FIG. 27 is a diagram of a circuit element of a pixel driving circuit provided by an embodiment of the present disclosure. FIG. 28 is a diagram of a circuit element of another pixel driving circuit provided by an embodiment of the present disclosure. FIG. 29 is a diagram of a circuit element of still another pixel driving circuit provided by an embodiment of the present disclosure. Referring to FIGS. 26 to 29, in an embodiment, a transistor in a threshold compensation unit 250 and a transistor in a first initialization unit 210 are of a same type; a first scan signal is reused as a fourth scan signal; a pixel driving circuit 20 further includes at least one second switch unit 291, the second switch unit 291 is electrically connected between a first end of the threshold compensation unit 250 and a second node N2, and/or, the second switch unit 291 is electrically connected to a second end of the threshold compensation unit 250 and a second electrode of a driving transistor 230; in a hold frame, the second switch unit 291 is configured to prevent the second electrode of the driving transistor 230 and the second node N2 from being turned on under the control of a fifth scan signal.

In an embodiment, the pixel driving circuit 20 further includes a fifth scan signal end S5 for receiving the fifth scan signal, and a control end of the second switch unit 291 is connected to the fifth scan signal end S5. In a data writing phase T2 of a write frame, the second switch unit 291 is configured to be turned on under the control of the fifth scan signal, and in the hold frame, the second switch unit 291 is configured to be turned off at least in the data writing phase T2 under the control of the fifth scan signal. Specifically, the second switch unit 291 includes a tenth transistor M10. When the second switch unit 291 is electrically connected between the first end of the threshold compensation unit 250 and the second node N2, a first electrode of the tenth transistor M10 is electrically connected to the second node N2, a second electrode of the tenth transistor M10 is electrically connected to the first end of the threshold compensation unit 250, and a control end of the tenth transistor M10 is electrically connected to the fifth scan signal end S5, as shown in FIGS. 28 and 29; when the second switch unit 291 is electrically connected between the second end of the threshold compensation unit 250 and the second electrode of the driving transistor 230, the first electrode of the tenth transistor M10 is electrically connected to the second end of the threshold compensation unit 250, the second electrode of the tenth transistor M10 is electrically connected to the second electrode of the driving transistor 230, and the control end of the tenth transistor M10 is electrically connected to the fifth scan signal end S5, as shown in FIGS. 27 and 29.

Figure 30:
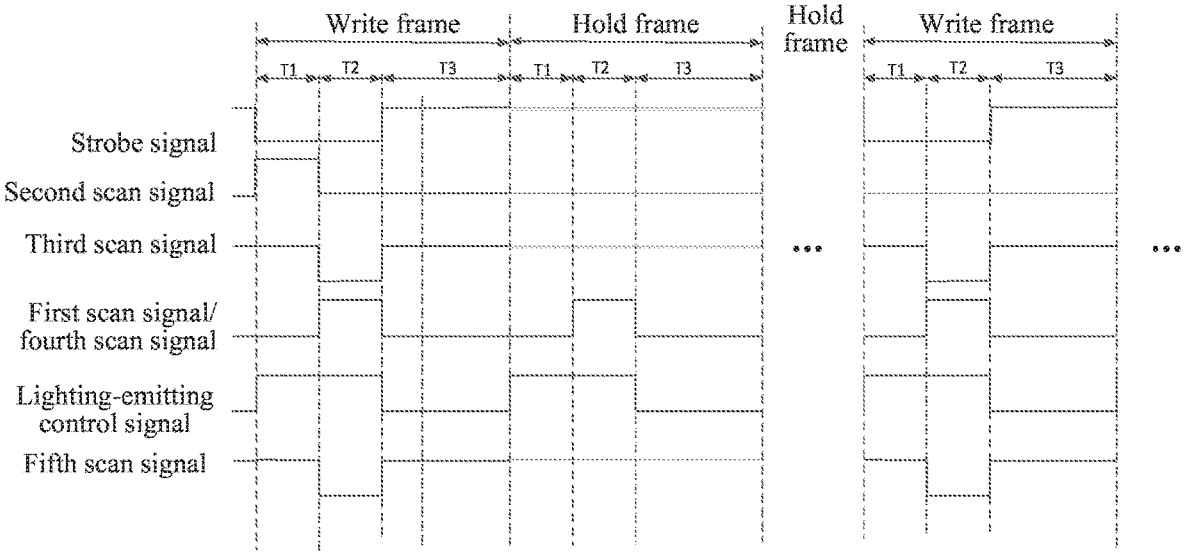
FIG. 30 is a driving timing diagram of a display panel provided by an embodiment of the present disclosure.

FIG. 30 is a driving timing diagram of a display panel provided by an embodiment of the present disclosure. Referring to FIG. 30, a time period corresponding to a valid pulse of a fourth scan signal is within a time period corresponding to a valid pulse of a strobe signal, and the time period corresponding to the valid pulse of the strobe signal does not exceed a time period corresponding to a whole write frame.

With continued reference to FIGS. 27 to 29, in an embodiment, a transistor in the threshold compensation unit 250 is an N-type transistor, and a transistor in the data writing unit 240 is a P-type transistor; or, the transistor in the threshold compensation unit 250 is a P-type transistor, and the transistor in the data writing unit 240 is an N-type transistor; a transistor in the second switch unit 291 and the transistor in the data writing unit 240 are of a same type; a third scan signal is reused as the fifth scan signal. In this way, the circuit for generating the fifth scan signal will be unnecessary, and therefore the design difficulty of the display panel can be reduced.

In an embodiment, a sixth transistor M6 is an N-type transistor, a tenth transistor M10 and a fifth transistor M5 are P-type transistors, as shown in FIG. 27; or, the sixth transistor M6 is a P-type transistor, and the tenth transistor M10 and the fifth transistor M10 are N-type transistors, as shown in FIGS. 28 and 29.

Figure 31:
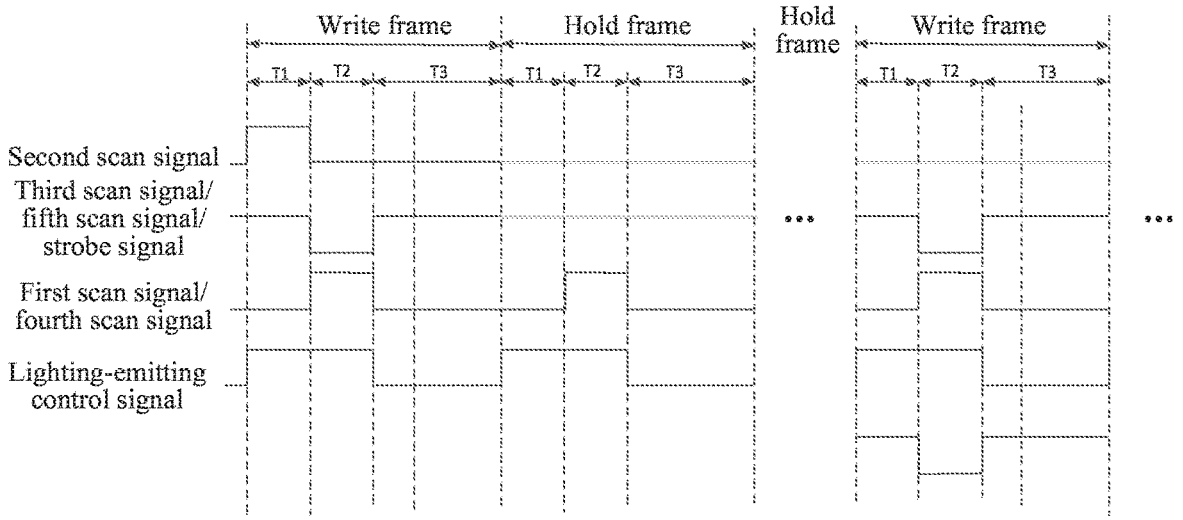
FIG. 31 is a driving timing diagram of another display panel provided by an embodiment of the present disclosure.
Figure 32:
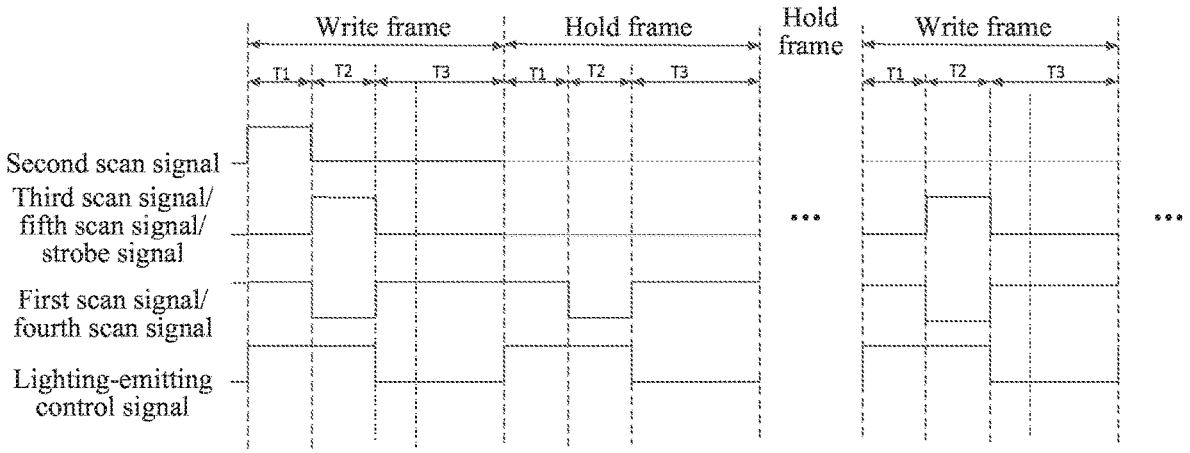
FIG. 32 is a driving timing diagram of still another display panel provided by an embodiment of the present disclosure.

FIG. 31 is a driving timing diagram of another display panel provided by an embodiment of the present disclosure. FIG. 32 is a driving timing diagram of still another display panel provided by an embodiment of the present disclosure. The driving timing diagrams shown in FIGS. 30 and 31 correspond to that the display panel includes the pixel driving circuit 20 shown in FIG. 27, and the driving timing diagram shown in FIG. 32 corresponds to that the display panel includes the pixel driving circuits shown in FIGS. 28 and 29.

With the driving timings shown in FIGS. 30 to 32, a working process of the pixel driving circuit 20 is described below. In an initialization phase T1 of a write frame, a second initialization unit 260 is turned on, and the second initialization unit 260 provides a first initialization voltage signal Vref1 to a second node N2. In a data writing phase T2 of the write frame, a first initialization unit 210 is turned on, the first initialization unit 210 provides the first initialization voltage signal Vref1 to an anode of a light-emitting element 30, and meanwhile, a data writing unit 240, a second switch unit 291 and a threshold compensation unit 250 are turned on. A data voltage signal of a data signal end Vdata is written into the second node N2 through the data writing unit 240, the driving transistor 230, the second switch unit 291 and the threshold compensation unit 250. In a light-emitting phase T3 of the write frame, a first light-emitting control unit 220 and a second light-emitting control unit 270 are turned on, a driving current generated by the driving transistor 230 flows into the light-emitting element 30, and the light-emitting element 30 emits light in response to the driving current. In the initialization phase T1 of the hold frame, there is no action. In the data writing phase T2 of the hold frame, the first initialization unit 210 is turned on, and the first initialization unit 210 provides a second initialization voltage signal Vref2 to the anode of the light-emitting element 30. Meanwhile, the threshold compensation unit 250 is turned on, and the second switch unit 291 is turned off, and a disconnected state is maintained between a second electrode of the driving transistor 230 and the second node N2. In the light-emitting phase T3 of the hold frame, the first light-emitting control unit 220 and the second light-emitting control unit 270 are turned on, a driving current generated by the driving transistor 230 flows into the light-emitting element 30, and the light-emitting element 30 emits light in response to the driving current.

In an embodiment, in the transistors in the threshold compensation unit 250 and the second switch unit 291, the transistor directly connected to the second node N2 is an indium gallium zinc oxide transistor.

Specifically, when the pixel driving circuit includes one second switch unit 291, and the second switch unit 291 is electrically connected between a second end of the threshold compensation unit 250 and the second electrode of the driving transistor 230, the tenth transistor M10 may be a low-temperature polysilicon transistor, the sixth transistor M6 may be an indium gallium zinc oxide transistor, as shown in FIG. 26. When the pixel driving circuit includes one second switch unit 291, and the second switch unit 291 is electrically connected between a first end of the threshold compensation unit 250 and the second node N2, the tenth transistor M10 may be an indium gallium zinc oxide transistor, and the sixth transistor M6 may be a low-temperature polysilicon transistor, as shown in FIG. 28. When the pixel driving circuit includes multiple second switch units 291, and at least one of the multiple second switch units 291 is electrically connected between the first end of the threshold compensation unit 250 and the second node N2, the tenth transistor M10 may be an indium gallium zinc oxide transistor, and the sixth transistor M6 may be a low-temperature polysilicon transistor, as shown in FIG. 29.

It should be understood that the indium gallium zinc oxide is one of the semiconductor oxides, and a leakage current of the indium gallium zinc oxide transistor is relatively small, which is conductive to stabilizing a voltage of the second node N2, thereby stabilizing the driving current generated by the driving transistor 230, and is conductive to improving the uniformity of the light-emitting brightness of the light-emitting element 30.

It should be noted that the timing sequences exemplarily shown in FIGS. 30 and 31 correspond to a situation that a fourth transistor M4, a fifth transistor M5, an eighth transistor M8, a tenth transistor M10 and the driving transistor 230 are P-type transistors, and a third transistor M3, a sixth transistor M6 and a seventh transistor M7 are N-type transistors; meanwhile, a first transistor M1 is a P-type transistor, and a second transistor M2 is an N-type transistor, or both the first transistor M1 and the second transistor M2 are P-type transistors. A timing sequence exemplarily shown in FIG. 32 corresponds to a situation that the third transistor M3, the fourth transistor M4, the sixth transistor M6, the eighth transistor M8, and the driving transistor 230 are P-type transistors, and the fifth transistor M5, the seventh transistor M7 and the tenth transistor M5 are P-type transistors; meanwhile, the first transistor M1 is an N-type transistor, and the second transistor M2 is a P-type transistor, or both the first transistor M1 and the second transistor M2 are N-type transistors, but it is not a limitation of the present application. The types of the transistors in the pixel driving circuit 20 and the gate circuit 10 are not specifically limited in the embodiments of the present disclosure.

It should also be noted that the driving timing diagrams shown in FIG. 14, FIG. 15, FIG. 16, FIG. 19, FIG. 20, FIG. 21, FIG. 22, FIG. 25, FIG. 30 and FIG. 31 are driving timing sequences of pixel driving circuits in one row in the display panel, and driving timing sequences of pixel driving circuits in other rows is similar to the above, which may be adaptively understood by those skilled in the art according to the idea of line-by-line scan.

Based on the same inventive concept as the above, an embodiment of the present disclosure further provides a display device, the display device includes the display panel described in any embodiment of the present disclosure. Therefore, the display device has the beneficial effects of the display panel provided by the embodiments of the present disclosure, and the similarities may be understood by referring to the above description, and will not repeated hereinafter.

Figure 33:
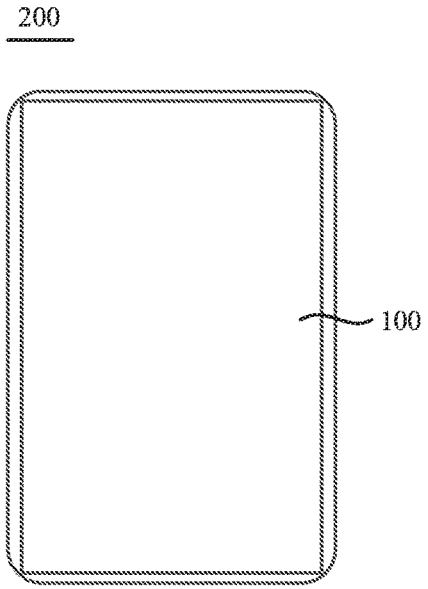
FIG. 33 is a structure diagram of a display device provided by an embodiment of the present disclosure.

In an embodiment, FIG. 33 is a structure diagram of a display device provided by an embodiment of the present disclosure. As shown in FIG. 30, the display device 200 provided by the embodiment of the present disclosure includes the display panel 100 provided by the embodiments of the present disclosure. The display device 200 may be, for example, any electronic equipment with a display function, such as a touch display screen, a mobile phone, a tablet computer, a laptop computer, or a television.

Figure 34:
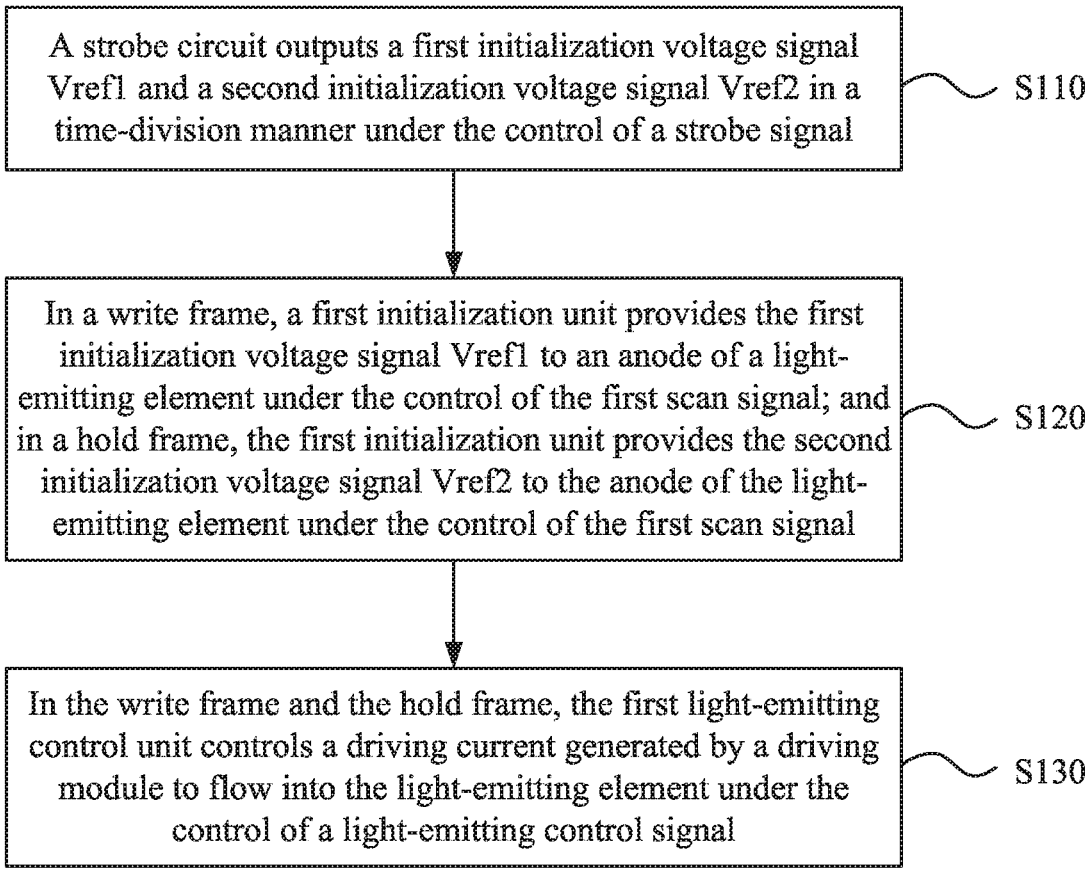
FIG. 34 is a flowchart of a driving method of a display panel provided by an embodiment of the present disclosure.

Based on the same inventive concept as the above, an embodiment of the present disclosure further provides a driving method of a display panel, applied to the display panel described in any embodiment of the present disclosure. FIG. 34 is a flowchart of a driving method of a display panel provided by an embodiment of the present disclosure. Referring to FIG. 34, the driving method specifically includes steps described below.

In S110, a strobe circuit 10 outputs a first initialization voltage signal Vref1 and a second initialization voltage signal Vref2 in a time-division manner under the control of a strobe signal.

In S120, in a write frame, a first initialization unit 210 provides the first initialization voltage signal Vref1 to an anode of a light-emitting element 30 under the control of a first scan signal; in a hold frame, the first initialization unit 210 provides the second initialization voltage signal Vref2 to the anode of the light-emitting element under the control of the first scan signal.

In S130, in the write frame and the hold frame, the first light-emitting control unit 220 controls a driving current generated by a driving module DM to flow into the light-emitting element 30 under the control of a light-emitting control signal.

In an embodiment, in the write frame, a voltage at a first node N1 at an initial light-emitting moment is V1; and in the hold frame, the voltage at the first node N1 at the initial light-emitting moment is V2; $(V1-V2)*(Vref2-Vref1)>0$.

In an embodiment, with continued reference to FIGS. 9 to 10, the strobe circuit 10 includes the first input end IN1, the second input end IN2, the first strobe branch 110, and the second strobe branch 120; the first input end IN1 is configured to receive the first initialization voltage signal Vref1, the first strobe branch 110 is electrically connected between the first input end IN1 and the initialization signal end Vref; the second input end IN2 is configured to receive the second initialization voltage signal Vref2, and the second strobe branch 120 is electrically connected between the second input end IN2 and the initialization signal end Vref.

The S110 specifically includes: in the write frame, the first strobe branch 110 provides the first initialization voltage signal Vref1 to the initialization signal end Vref under the control of the strobe signal; in the hold frame, the second strobe branch 120 is configured to provide the second initialization voltage signal Vref2 to the initialization signal end Vref under the control of the strobe signal.

In an embodiment, the display panel includes multiple pixel driving circuits 20 and multiple strobe circuits 10, and each of the multiple strobe circuits 10 is electrically connected to a respective one of the multiple pixel driving circuits 20, as shown in FIG. 7; or, the display panel includes multiple pixel driving circuits 20 and multiple strobe circuits 10, and the multiple pixel driving circuits 20 are arranged in an array; an initialization signal end Vref of each row of pixel driving circuits 20 is electrically connected to a same one of the multiple strobe circuits 10, as shown in FIGS. 5 and 6; the strobe signal of the multiple strobe circuits 10 is reused as the second scan signal (as shown in FIG. 14), the third scan signal (as shown in FIG. 15), or the fourth scan signal (as shown in FIG. 16) of the multiple pixel driving circuits 20 electrically connected to the multiple strobe circuits 10.

In an embodiment, with continued reference to FIGS. 11 and 12, the pixel driving circuit 20 includes the first power supply signal end PVDD; the driving module DM includes the storage unit 280, the driving transistor 230, the data writing unit 240, the threshold compensation unit 250, the second initialization Unit 260 and the second light-emitting control unit 270. The second initialization unit 260 is electrically connected between the initialization signal end Vref and the second node N2. The control end of the driving transistor 230 and the first end of the storage unit 280 are electrically connected to the second Node N2. The second end of the storage unit 280 is electrically connected to the first power supply signal end PVDD; the data writing unit 240 is electrically connected between the data signal end Vdata and the first electrode of the driving transistor 230; the threshold compensation unit 250 is electrically connected between the second electrode of the driving transistor 230 and the second node N2, and the second light-emitting control unit 270 is electrically connected between the first power supply signal end PVDD and the first electrode of the driving transistor 230.

The driving method further includes described below.

In the write frame, the second initialization unit provides the first initialization voltage signal Vref1 to the second node N2 under the control of the second scan signal.

In the write frame, the data writing unit provides a data voltage signal to the second node N2 under the control of the third scan signal, and the threshold compensation unit compensates a threshold voltage of the driving transistor to the second node N2 under the control of the fourth scan signal.

In the write frame and the hold frame, the light-emitting control unit writes a first power supply voltage signal into the first electrode of the driving transistor under the control of the light-emitting control signal.

In an embodiment, a time period corresponding to a valid pulse of the second scan signal is within a time period corresponding to a valid pulse of the first scan signal. In an embodiment, the time period corresponding to the valid pulse of the second scan signal coincides with the time period corresponding to the valid pulse of the first scan signal, as shown in FIG. 14. In this way, it can be ensured that, in the initialization phase of the hold frame, the second initialization unit may reset the anode of the light-emitting element, and the possibility of the light-emitting of the light-emitting element caused by a potential of the anode of the light-emitting element being in a floating state in the initialization phase of the hold frame is avoided, and thus the ununiformed display is avoided.

In an embodiment, a time period corresponding to the valid pulse of the first scan signal coincides with a time period corresponding to an invalid pulse of the light-emitting control signal. In this way, it can be ensured that, in the initialization phase and the data writing phase of the hold frame, the second initialization unit may reset the anode of the light-emitting element, that is, in the initialization phase and the data writing phase of the hold frame, a voltage of the anode of the light-emitting element is a voltage value corresponding to the second initialization voltage signal, so that the light-emitting element is determined not to emit light in the initialization phase and the data writing phase of the hold frame.

In an embodiment, the transistor in the first initialization unit 210 is an N-type transistor, and the transistor in the light-emitting control unit is a P-type transistor, as shown in FIG. 17; or, the transistor in the first initialization unit 210 is a P-type transistor, and the transistor in the control unit is an N-type transistor, as shown in FIG. 18; the light-emitting control signal is reused as the first scan signal, as shown in FIGS. 19 and 20.

In an embodiment, the transistor in the data writing unit 240 and the transistor in the second initialization unit 260 are of a same type; the first scan signal is reused as the third scan signal, as shown in FIGS. 21 and 22.

In an embodiment, in the hold frame, the data writing unit 240 is configured to transfer a fixed voltage signal provided by the data signal end Vdata to the first electrode of the driving transistor 230 under the control of the third scan signal; a voltage value of the fixed voltage signal is equal to a voltage value of the first power supply voltage signal.

In an embodiment, with continued reference to FIG. 23, the pixel driving circuit further includes the first switch unit, which is electrically connected between the data writing unit and the first power supply signal end; in the hold frame, the first switch unit is configured to transfer the first power supply voltage signal to the data writing unit under the control of the sixth scan signal, enabling the data writing unit to provide the first power supply voltage signal to the first electrode of the driving transistor under the control of the third scan signal.

In an embodiment, with continued reference to FIGS. 26 to 32, the transistor in the threshold compensation unit 250 and the transistor in the first initialization unit 210 are of a same type; the first scan signal is reused as the fourth scan signal; the pixel driving circuit 20 further includes at least one second switch unit 291, the second switch unit 291 is electrically connected between the first end of the threshold compensation unit 250 and the second node N2, and/or, the second switch unit 291 is electrically connected to the second end of the threshold compensation unit 250 and the second electrode of the driving transistor 230; in the hold frame, the second switch unit 291 is configured to prevent the second electrode of the driving transistor 230 and the second node N2 from being turned on under the control of the fifth scan signal.

The driving method of the display panel provided by the embodiments of the present disclosure has the beneficial effects of the display panel provided by the embodiments of the present disclosure. The similarities may be understood by referring to the above description, and will not be repeated here.

It should be noted that the above are merely some embodiments of the present disclosure and the technical principles applied herein. It should be understood by those skilled in the art that the present disclosure is not limited to the specific embodiments described herein. For those skilled in the art, various apparent modifications, adaptations, combinations and substitutions may be made without departing from the scope of protection of the present disclosure. Therefore, although the present disclosure has been described in detail through the above embodiments, the present disclosure is not limited to the above embodiments and may further include more other equivalent embodiments without departing from the concept of the present disclosure. The scope of the present disclosure is determined by the scope of the appended claims.

What is claimed is:

1. A display panel, comprising a strobe circuit, a pixel driving circuit and a light-emitting element, wherein the pixel driving circuit comprises an initialization signal end, a data signal end, a first initialization unit, a driving module, and a first light-emitting control unit;

wherein the strobe circuit is electrically connected to the initialization signal end; and the strobe circuit is configured to output a first initialization voltage signal Vref1 and a second initialization voltage signal Vref2 in a time-division manner under the control of a strobe signal;

wherein the first initialization unit is electrically connected between the initialization signal end and an anode of the light-emitting element; in a write frame, the first initialization unit is configured to provide the first initialization voltage signal Vref1 to the anode of the light-emitting element under the control of a first scan signal; and in a hold frame, the first initialization unit is configured to provide the second initialization voltage signal Vref2 to the anode of the light-emitting element under the control of the first scan signal;

wherein the driving module and a first end of the first light-emitting control unit are electrically connected to a first node, and a second end of the first light-emitting control unit is electrically connected to the anode of the light-emitting element; in the write frame and the hold frame, the first light-emitting control unit is configured to control a driving current generated by the driving module to flow into the light-emitting element under the control of a light-emitting control signal; and wherein a time period corresponding to a valid pulse of the first scan signal is within a time period corresponding to an invalid pulse of the light-emitting control signal; in the write frame, the driving module is configured to receive a data voltage signal provided by the data signal end; and in the hold frame, the driving module is configured to not receive the data voltage signal.

2. The display panel of claim 1, wherein in the write frame, a voltage at the first node at an initial light-emitting moment is V1; and in the hold frame, the voltage at the first node at the initial light-emitting moment is V2; (V1−V2)* (Vref2−Vref1)>0.

3. The display panel of claim 1, wherein the display panel comprises a plurality of the pixel driving circuits and a plurality of the strobe circuits, and each of the plurality of strobe circuits is electrically connected to a respective one of the plurality of pixel driving circuits.

4. The display panel of claim 1, wherein the display panel comprises a display area and a non-display area surrounding the display area, and the strobe circuit is located in the non-display area.

5. The display panel of claim 4, wherein the display panel comprises a plurality of the pixel driving circuits and one strobe circuit; and an initialization signal end of each of the plurality of pixel driving circuits is electrically connected to the strobe circuit.

6. The display panel of claim 4, wherein the display panel comprises a plurality of the pixel driving circuits and a plurality of the strobe circuits, and the plurality of pixel driving circuits are arranged in an array;

wherein an initialization signal end of each row of pixel driving circuits is electrically connected to a same one of the plurality of strobe circuits.

7. The display panel of claim 1, wherein the strobe circuit comprises a first input end, a second input end, a first strobe branch, and a second strobe branch;

wherein the first input end is configured to receive the first initialization voltage signal Vref1, and the first strobe branch is electrically connected between the first input end and the initialization signal end; the first strobe branch is configured to provide the first initialization voltage signal Vref1 to the initialization signal end under the control of the strobe signal; and wherein the second input end is configured to receive the second initialization voltage signal Vref2, and the second strobe branch is electrically connected between the second input end and the initialization signal end; the second strobe branch is configured to provide the second initialization voltage signal Vref2 to the initialization signal end under the control of the strobe signal.

8. The display panel of claim 7, wherein the first strobe branch comprises a first transistor, and the second strobe branch comprises a second transistor;

wherein the first transistor is a P-type transistor, and the second transistor is an N-type transistor; or, the first transistor is an N-type transistor, and the second transistor is a P-type transistor; and a control end of the first transistor and a control end of the second transistor are both configured to receive the strobe signal.

9. The display panel of claim 7, wherein the first strobe branch comprises a first transistor, and the second strobe branch comprises a second transistor and a first inverter;

wherein the first transistor and the second transistor are of a same type; and a control end of the first transistor and a control end of the second transistor are both configured to receive the strobe signal.

10. The display panel of claim 1, wherein the pixel driving circuit comprises a first power supply signal end; the driving module comprises a storage unit, a driving transistor, a data writing unit, a threshold compensation unit, a second initialization unit, and a second light-emitting control unit;

wherein the second initialization unit is electrically connected between the initialization signal end and a second node; and in the write frame, the second initialization unit is configured to provide the first initialization voltage signal Vref1 to the second node under the control of a second scan signal;

wherein a control end of the driving transistor and a first end of the storage unit are electrically connected to the second node; and a second end of the storage unit is electrically connected to the first power supply signal end;

wherein the data writing unit is electrically connected between the data signal end and a first electrode of the driving transistor; the threshold compensation unit is electrically connected between a second electrode of the driving transistor and the second node; in the write frame, the data writing unit is configured to provide the data voltage signal to the second node under the control of a third scan signal, and the threshold compensation unit is configured to compensate a threshold voltage of the driving transistor to the second node under the control of a fourth scan signal; and wherein the second light-emitting control unit is electrically connected between the first power supply signal end and the first electrode of the driving transistor; in the write frame and the hold frame, the second light-emitting control unit is configured to write a first power supply voltage signal into the first electrode of the driving transistor under the control of the light-emitting control signal.

11. The display panel of claim 10, wherein, the display panel comprises a plurality of the pixel driving circuits and a plurality of the strobe circuits, and each of the plurality of the strobe circuits is electrically connected to a respective one of the plurality of the pixel driving circuits;

or, the display panel comprises a plurality of the pixel driving circuits and a plurality of the strobe circuits, the plurality of the pixel driving circuits are arranged in an array, and an initialization signal end of each row of pixel driving circuits is electrically connected to a same one of the plurality of the strobe circuits;

wherein the strobe signal of the plurality of the strobe circuits is reused as the second scan signal, the third scan signal or the fourth scan signal of the plurality of the pixel driving circuits electrically connected to the plurality of the strobe circuits.

12. The display panel of claim 1, wherein a transistor in the first initialization unit is an N-type transistor, and a transistor in the first light-emitting control unit is a P-type transistor; or, a transistor in the first initialization unit is a P-type transistor, and a transistor in the first light-emitting control unit is an N-type transistor;

wherein the light-emitting control signal is reused as the first scan signal.

13. The display panel of claim 10, wherein a transistor in the data writing unit and a transistor in the first initialization unit are of a same type, and the first scan signal is reused as the third scan signal.

14. The display panel of claim 13, wherein, in the hold frame, the data writing unit is configured to transmit a fixed voltage signal provided by the data signal end to the first electrode of the driving transistor under the control of the third scan signal;

wherein a voltage value of the fixed voltage signal is equal to a voltage value of the first power supply voltage signal.

15. The display panel of claim 13, wherein the pixel driving circuit further comprises a first switch unit, and the first switch unit is electrically connected between the data writing unit and the first power supply signal end;

wherein in the hold frame, the first switch unit is configured to transfer the first power supply voltage signal to the data writing unit, enabling the data writing unit to provide the first power supply voltage signal to the first electrode of the driving transistor under the control of the third scan signal.

16. The display panel of claim 10, wherein a transistor in the threshold compensation unit and a transistor in the first initialization unit are of a same type, and the first scan signal is multiplexed into the fourth scan signal;

wherein the pixel driving circuit further comprises at least one second switch unit; the at least one second switch unit is electrically connected between a first end of the threshold compensation unit and the second node, and/or the at least one second switch unit is electrically connected between a second end of the threshold compensation unit and the second electrode of the driving transistor; and wherein in the hold frame, the second switch unit is configured to prevent the second electrode of the driving transistor and the second node from being turned on under the control of a fifth scan signal.

17. The display panel of claim 16, wherein the transistor in the threshold compensation unit is an N-type transistor, and a transistor in the data writing unit is a P-type transistor; or, the transistor in the threshold compensation unit is a P-type transistor, and a transistor in the data writing unit is an N-type transistor;

wherein a transistor in the second switch unit and the transistor in the data writing unit are of the same type; and the third scan signal is multiplexed into the fifth scan signal; and wherein among transistors in the threshold compensation unit and the second switch unit, a transistor directly connected to the second node is an indium gallium zinc oxide transistor.

18. The display panel of claim 10, wherein transistors in the threshold compensation unit and the second initialization unit are semiconductor oxide transistors.

19. A display device, comprising a display panel;

wherein the display panel comprises a strobe circuit, a pixel driving circuit and a light-emitting element, wherein the pixel driving circuit comprises an initialization signal end, a data signal end, a first initialization unit, a driving module, and a first light-emitting control unit;

wherein the strobe circuit is electrically connected to the initialization signal end; and the strobe circuit is configured to output a first initialization voltage signal Vref1 and a second initialization voltage signal Vref2 in a time-division manner under the control of a strobe signal;

wherein the first initialization unit is electrically connected between the initialization signal end and an anode of the light-emitting element; in a write frame, the first initialization unit is configured to provide the first initialization voltage signal Vref1 to the anode of the light-emitting element under the control of a first scan signal; and in a hold frame, the first initialization unit is configured to provide the second initialization voltage signal Vref2 to the anode of the light-emitting element under the control of the first scan signal;

wherein the driving module and a first end of the first light-emitting control unit are electrically connected to a first node, and a second end of the first light-emitting control unit is electrically connected to the anode of the light-emitting element; in the write frame and the hold frame, the first light-emitting control unit is configured to control a driving current generated by the driving module to flow into the light-emitting element under the control of a light-emitting control signal; and wherein a time period corresponding to a valid pulse of the first scan signal is within a time period corresponding to an invalid pulse of the light-emitting control signal; in the write frame, the driving module is configured to receive a data voltage signal provided by the data signal end; and in the hold frame, the driving module is configured to not receive the data voltage signal.

20. A driving method of a display panel, wherein the display panel comprises a strobe circuit, a pixel driving circuit and a light-emitting element, wherein the pixel driving circuit comprises an initialization signal end, a data signal end, a first initialization unit, a driving module, and a first light-emitting control unit;

wherein the strobe circuit is electrically connected to the initialization signal end; and the strobe circuit is configured to output a first initialization voltage signal Vref1 and a second initialization voltage signal Vref2 in a time-division manner under the control of a strobe signal;

wherein the first initialization unit is electrically connected between the initialization signal end and an anode of the light-emitting element; in a write frame, the first initialization unit is configured to provide the first initialization voltage signal Vref1 to the anode of the light-emitting element under the control of a first scan signal; and in a hold frame, the first initialization unit is configured to provide the second initialization voltage signal Vref2 to the anode of the light-emitting element under the control of the first scan signal;

wherein the driving module and a first end of the first light-emitting control unit are electrically connected to a first node, and a second end of the first light-emitting control unit is electrically connected to the anode of the light-emitting element; in the write frame and the hold frame, the first light-emitting control unit is configured to control a driving current generated by the driving module to flow into the light-emitting element under the control of a light-emitting control signal;

wherein a time period corresponding to a valid pulse of the first scan signal is within a time period corresponding to an invalid pulse of the light-emitting control signal; in the write frame, the driving module is configured to receive a data voltage signal provided by the data signal end; and in the hold frame, the driving module is configured to not receive the data voltage signal; and wherein the method comprises:

outputting, by the strobe circuit, a first initialization voltage signal Vref1 and a second initialization voltage signal Vref2 in a time-division manner under the control of a strobe signal;

in a write frame, providing, by the first initialization unit, the first initialization voltage signal Vref1 to the anode of the light-emitting element under the control of the first scan signal; and in a hold frame, providing, by the first initialization unit, the second initialization voltage signal Vref2 to the anode of the light-emitting element under the control of the first scan signal; and in the write frame and the hold frame, controlling, by the first light-emitting control unit, a driving current generated by the driving module to flow into the light-emitting element under the control of the light-emitting control signal.

* * * * *